US010732545B2

(12) United States Patent
Takeuchi et al.

(10) Patent No.: US 10,732,545 B2
(45) Date of Patent: Aug. 4, 2020

(54) CARTRIDGE REMANUFACTURING METHOD AND CARTRIDGE

(71) Applicant: CANON KABUSHIKI KAISHA, Tokyo (JP)

(72) Inventors: Toshiaki Takeuchi, Susono (JP); Shuichi Gofuku, Numazu (JP); Yu Akiba, Susono (JP); Shota Nakamura, Yokohama (JP); Masakazu Tatsumi, Susono (JP); Hiroki Shimizu, Suntou-gun (JP); Tomofumi Kawamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/546,768

(22) Filed: Aug. 21, 2019

(65) Prior Publication Data

US 2020/0073286 A1 Mar. 5, 2020

(30) Foreign Application Priority Data

Aug. 29, 2018 (JP) ..... 2018-160404
Feb. 28, 2019 (JP) ..... 2019-035574

(51) Int. Cl.
*G03G 15/00* (2006.01)
*G03G 15/08* (2006.01)
*G03G 21/16* (2006.01)

(52) U.S. Cl.
CPC ..... *G03G 15/0894* (2013.01); *G03G 15/0863* (2013.01); *G03G 21/1652* (2013.01)

(58) Field of Classification Search
CPC ..... G03G 15/0894; G03G 15/0863; G03G 21/181; G03G 21/1867; G03G 21/1875; G03G 21/1885
USPC ..... 399/12, 90, 109
See application file for complete search history.

(56) References Cited

U.S. PATENT DOCUMENTS 7,054,577 B2 * 5/2006 Rogers et al. ..... G03G 15/0894 399/109
7,068,963 B2 * 6/2006 Moore et al. ..... G03G 15/0844 399/109
7,424,245 B2 * 9/2008 Burchette et al. ... G03G 21/181 399/109

(Continued)

FOREIGN PATENT DOCUMENTS

JP 2003-330335 A 11/2003
JP 2016-224221 A 12/2016

*Primary Examiner* — William J Royer
(74) *Attorney, Agent, or Firm* — Venable LLP

(57) ABSTRACT

A method for remanufacturing a cartridge from a source cartridge, wherein the source cartridge includes a first unit and a second unit, the first unit including a first memory unit having a first electrode and a first storage element electrically connected to the first electrode. The method includes removing the first memory unit from the first unit, attaching a second electrode of a second memory unit to the first unit, and attaching a second storage element of the second memory unit to the second unit. The second electrode and the second storage element are connected by a connecting member so that when the second unit moves relative to the first unit, electrical connection between the second electrode and the second storage element is maintained, and the second electrode is electrically connected to a main body electrode of an information apparatus.

25 Claims, 19 Drawing Sheets

(56) References Cited

U.S. PATENT DOCUMENTS

| | | | | |
|---|---|---|---|---|
| 7,689,144 | B2 * | 3/2010 | Martin et al. ..... | G03G 15/0894<br>399/109 |
| 2003/0215261 | A1 | 11/2003 | Karakama et al. | |
| 2017/0261923 | A1 | 9/2017 | Miyamoto et al. | |

* cited by examiner

CARTRIDGE REMANUFACTURING METHOD AND CARTRIDGE

BACKGROUND OF THE INVENTION

Field of the Invention

The present invention relates to a cartridge used in an image forming apparatus such as a copier, a printer, or a facsimile device, and a cartridge remanufacturing method.

Description of the Related Art

In an image forming apparatus using an electrophotographic image formation system (an electrophotographic process), a photosensitive member (referred to hereafter as a "photosensitive drum") serving as an image carrier member is uniformly charged. Next, by selectively exposing the charged photosensitive drum, an electrostatic latent image is formed on the surface of the photosensitive drum. Next, the electrostatic latent image formed on the surface of the photosensitive drum is developed as a toner image using toner as a developer. The toner image formed on the surface of the photosensitive drum is then transferred onto a recording material such as recording paper or a plastic sheet. Further, the toner image transferred onto the recording material is fixed to the recording material by applying heat and pressure to the toner image, and thus, image formation is performed.

In this type of image forming apparatus, various process means typically require maintenance. To facilitate maintenance of the various process means, a cartridge which can be attached to and detached from the image forming apparatus and in which a photosensitive drum such as that described above, charging means, developing means, cleaning means, and so on are gathered together inside a frame has been put to practical use. By adopting this cartridge system, an image forming apparatus exhibiting superior usability can be provided.

Further, Japanese Patent Application Publication No. 2003-330335, for example, provides a product in which memory means for recording service information and process information is disposed in a process cartridge. By making use of the information on the process cartridge in the image forming apparatus, improvements in image quality and maintenance of the process cartridge are achieved.

This type of process cartridge is used to form an image on a recording medium using toner. Hence, toner is consumed every time an image is formed. When the toner has been consumed to the extent that it is no longer possible to form images of a sufficiently high quality to satisfy the user who purchased the process cartridge, the process cartridge comes to the end of its life.

In recent years, a method for recommodifying a process cartridge that has lost its commercial value by coming to the end of its life due to the toner therein being consumed has been proposed. In this process cartridge remanufacturing method, a method for removing the memory means attached to the frame of the process cartridge and attaching new memory means has been considered.

However, the memory means may differ in size and shape depending on the product. An attachment portion to which the memory means is attached may also differ in shape. It is therefore necessary to prepare separate memory means corresponding to the shape of the attachment portion of each cartridge.

Moreover, in recent years, as image forming apparatuses have decreased in size, cartridges are also becoming smaller and smaller. Hence, there may also be restrictions on the shape and size of the memory means that can be attached to the cartridge.

Therefore, in consideration of the problems described above, an object of the present invention is to provide a remanufacturing method with which a first memory unit attached to a cartridge prior to remanufacturing can be replaced with a second memory unit having a different shape to the first memory unit.

SUMMARY OF THE INVENTION

In order to achieve the object described above, a cartridge remanufacturing method for remanufacturing a cartridge from a source cartridge, wherein the source cartridge is capable of being attached to and detached from an image forming apparatus having a main body electrode and the cartridge is capable of being attached to and detached from the image forming apparatus, and the source cartridge includes a first unit and a second unit, the first unit including a first memory unit having a first electrode that is capable of being electrically connected to the main body electrode and a first storage element electrically connected to the first electrode, and the second unit being joined to the first unit so as to be capable of moving relative to the first unit, the cartridge remanufacturing method including:

a step of removing the first memory unit from the first unit; and a memory attachment step of attaching a second memory, the memory attachment step including a step of attaching a second electrode to the first unit and a step of attaching a second storage element to the second unit, wherein the second electrode and the second storage element are connected by a connecting member so that when the second unit moves relative to the first unit, electrical connection between the second electrode and the second storage element is maintained, and the second electrode is disposed so as to be electrically connectable to the main body electrode.

In order to achieve the object described above, a cartridge remanufacturing method for remanufacturing a cartridge from a source cartridge, wherein the source cartridge is capable of being attached to and detached from an image forming apparatus having a main body electrode and the cartridge is capable of being attached to and detached from the image forming apparatus, and the source cartridge includes a first unit and a second unit, the second unit including a first memory unit having a first electrode that is capable of being electrically connected to the main body electrode and a first storage element electrically connected to the first electrode, and the second unit being joined to the first unit so as to be capable of moving relative to the first unit, the cartridge remanufacturing method including:

a step of removing the first memory unit from the second unit; and a memory attachment step of attaching a second memory unit, the memory attachment step including a step of attaching a second electrode to the second unit and a step of attaching a second storage element to the first unit, wherein the second electrode and the second storage element are connected by a connecting member so that when the second unit moves relative to the first unit, electrical connection between the second electrode and the second storage element is maintained, and the second electrode is disposed so as to be electrically connectable to the main body electrode.

In order to achieve the object described above, a cartridge that is capable of being attached to and detached from an image forming apparatus having a main body electrode, including:

a photosensitive member unit including a drum frame and a drum that has a photosensitive layer and is supported rotatably by the drum frame;

a developing unit including a developing frame and a developer carrier member supported rotatably by the developing frame and configured to supply developer to the drum, the developing unit being joined to the photosensitive member unit so as to be capable of moving relative to the photosensitive member unit; and a memory unit including an electrode that is capable of being electrically connected to the main body electrode, a storage element, and a connecting member for electrically connecting the electrode to the storage element, wherein the electrode is disposed on one of the photosensitive member unit and the developing unit and the storage element is disposed on the other of the photosensitive member unit and the developing unit, and the developing unit is configured to be capable of moving relative to the photosensitive member unit in a state where electrical connection between the electrode and the storage element is maintained by the connecting member.

In order to achieve the object described above, a cartridge that is capable of being attached to and detached from an image forming apparatus having a main body electrode, including:

a frame;

a developer carrier member supported rotatably by the frame;

an end member attached to one end portion of the frame in a rotary axis direction of the developer carrier member; and a memory unit including an electrode that is capable of being electrically connected to the main body electrode, a storage element, and a connecting member for electrically connecting the electrode to the storage element, wherein the electrode is disposed on the end member and the storage element is disposed on the frame, and the frame is capable of rotating relative to the end member about a rotary axis in a state where electrical connection between the electrode and the storage element is maintained by the connecting member.

Further features of the present invention will become apparent from the following description of exemplary embodiments (with reference to the attached drawings).

DESCRIPTION OF THE EMBODIMENTS

Exemplary modes for carrying out the present invention will be described in detail below on the basis of embodiments and with reference to the figures. Note, however, that dimensions, materials, shapes, relative arrangements, and so on of constituent components described in the following embodiments may be modified as appropriate in accordance with the configuration of the apparatus to which the invention is applied and various conditions. In other words, the scope of this invention is not limited to the following embodiments.

First Embodiment

A developing apparatus, a cartridge, a process cartridge 7, and an image forming apparatus 100 according to a first embodiment of the present invention will now be described using FIGS. 2 to 4.

Electrophotographic Image Forming Apparatus

First, the overall configuration of an electrophotographic image forming apparatus (referred to hereafter as an "image forming apparatus") according to this embodiment will be described using FIGS. 2, 3, and 4.

Figure 2:
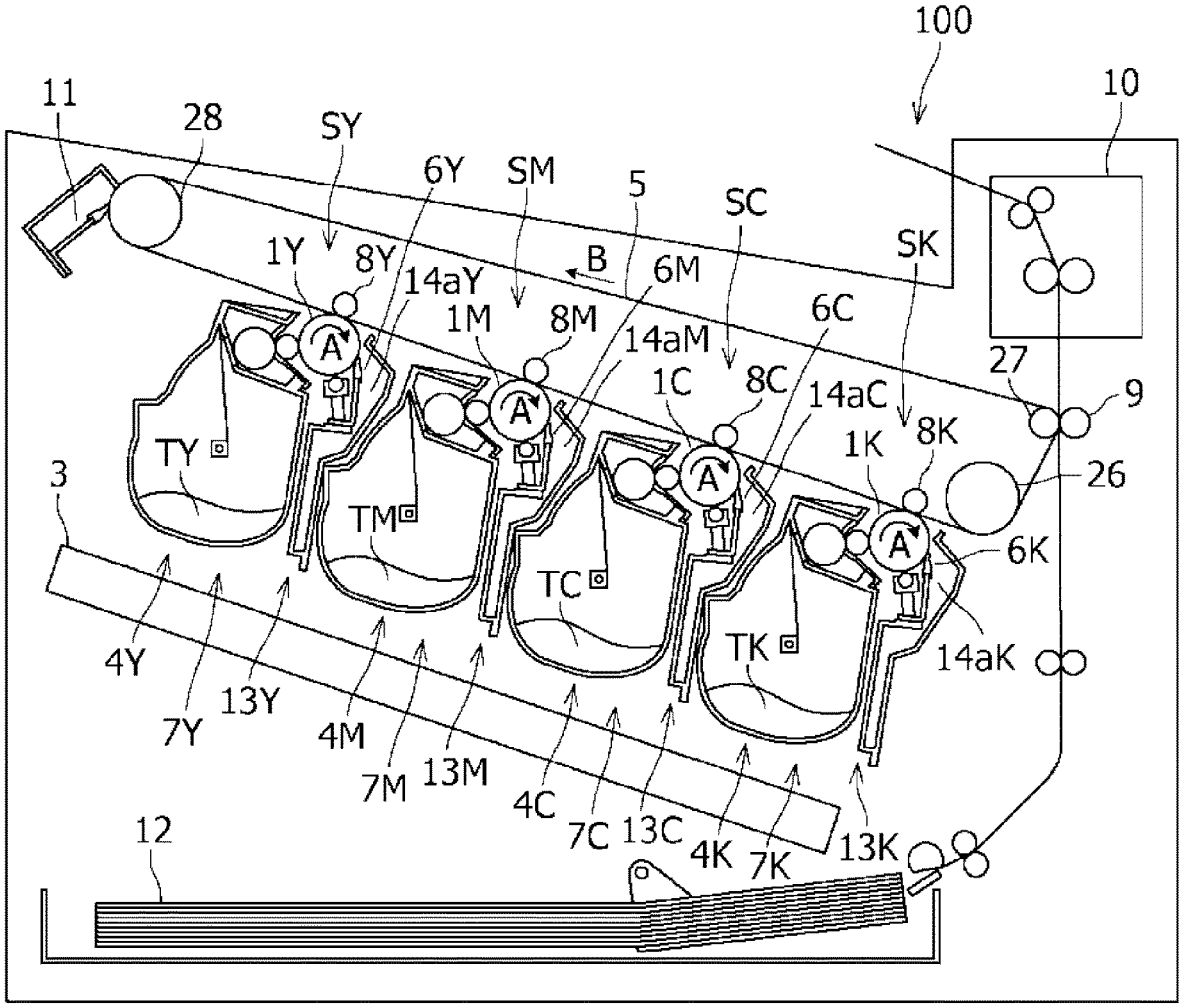
FIG. 2 is a sectional view of an electrophotographic image forming apparatus according to the first embodiment.

FIG. 2 is a sectional view of the image forming apparatus 100. FIG. 3 is a perspective view showing a state in which the process cartridges 7Y, 7M, 7C, and 7K are attached to the image forming apparatus 100. FIG. 4 is a sectional view of the process cartridge 7.

The image forming apparatus 100 includes, as a plurality of image forming portions, first, second, third, and fourth image forming portions SY, SM, SC, and SK for forming images in respective colors, namely yellow (Y), magenta (M), cyan (C), and black (K).

In this embodiment, the configurations and operations of the first to fourth image forming portions SY, SM, SC, and SK are substantially identical, except for the colors of the images formed thereby. Hereafter, therefore, when there is no particular need to distinguish between the first to fourth image forming portions, SY, SM, SC, and SK will be omitted and the respective image forming portions SY, SM, SC, and SK will be described collectively.

More specifically, in this embodiment, the image forming apparatus 100 includes four electrophotographic photosensitive drums (referred to hereafter as "photosensitive drums") 1 (1Y, 1M, 1C, 1K) serving as image carrier members. Each photosensitive drum 1 includes a photosensitive layer on the outer peripheral surface thereof and rotates in the direction of an arrow A in the figure. Further, a charging roller 2 and a scanner unit 3 are disposed on the periphery of the photosensitive drum 1. The photosensitive drum 1 serves as an example of a rotary body.

Here, the charging roller 2 serves as charging means for uniformly charging the surface of the photosensitive drum 1. The scanner unit 3 serves as exposing means for forming an electrostatic image on the photosensitive drum 1 by irradiating the photosensitive drum 1 with a laser on the basis of image information. Further, a developing device (referred to hereafter as a "developing unit") 4 (4Y, 4M, 4C, 4K) and a cleaning blade 6 (6Y, 6M, 6C, 6K) serving as cleaning means are disposed on the periphery of the photosensitive drum 1. Furthermore, an intermediate transfer belt 5 is disposed opposite the four photosensitive drums 1 as an intermediate transfer body for transferring toner images on the photosensitive drums 1 onto a recording material 12.

Further, in this embodiment, the developing unit 4 uses a non-magnetic mono-component developer, or in other words toner T (TY, TM, TC, TK), as a developer. In this embodiment, the developing unit 4 performs contact development by bringing a developer carrier member (referred to hereafter as a "developing roller") 22 serving as developing means into contact with the photosensitive drum 1.

In this embodiment, a photosensitive member unit 13 (3Y, 13M, 13C, 13K) including the photosensitive drum 1, the charging roller 2, the cleaning blade 6, and a waste toner housing portion 14*a* (14*a*Y, 14*a*M, 14*a*C, 14*a*K) is formed. The waste toner housing portion 14*a* houses primary transfer residual toner remaining on the photosensitive drum 1. Further, by forming the developing unit 4 and the photosensitive member unit 13 integrally in the form of a cartridge, the process cartridge 7 (7Y, 7M, 7C, 7K) is formed. The process cartridge 7 can be attached to and detached from the image forming apparatus 100 via attaching means provided in the image forming apparatus 100, such as an attachment guide or a positioning member, not shown in the figure.

Figure 3:
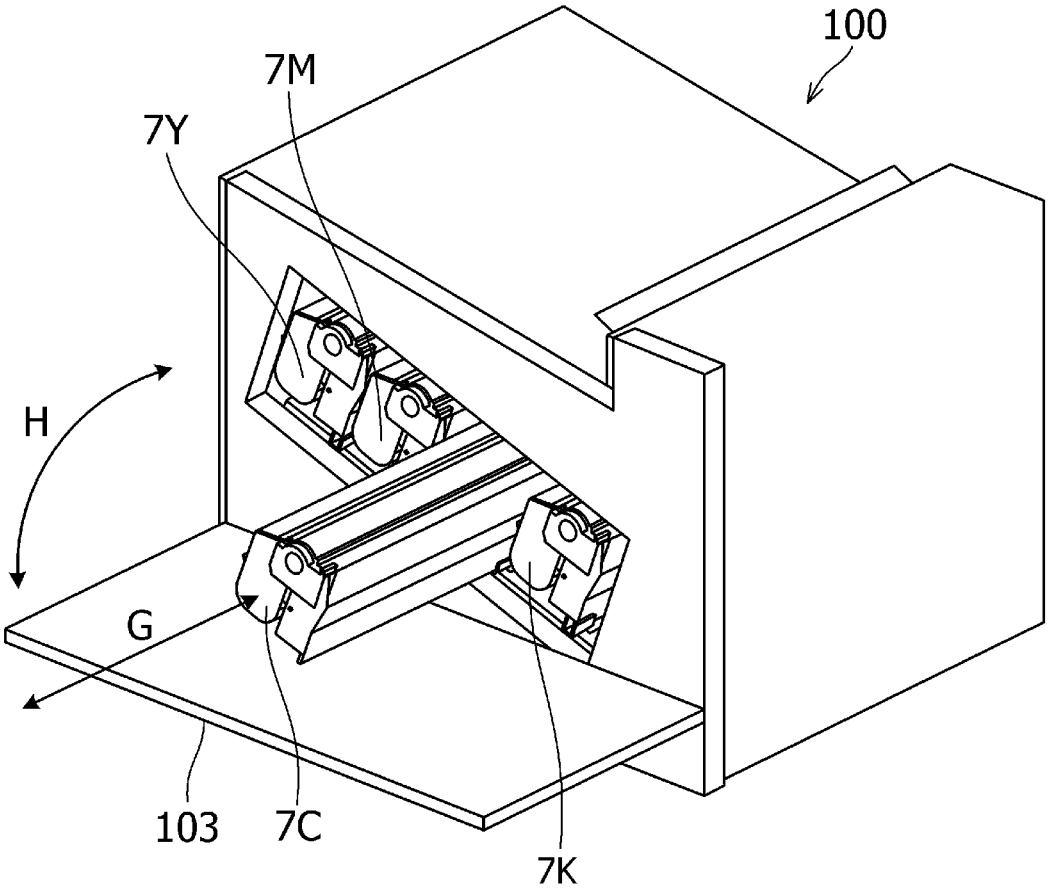
FIG. 3 is a perspective view in which the process cartridge is attached to the electrophotographic image forming apparatus according to the first embodiment.

Further, as indicated by an arrow G in FIG. 3, the process cartridge 7 can be attached to and detached from the image forming apparatus 100 in an axial direction of the photosensitive drum 1. In this embodiment, the process cartridges 7 of the respective colors have identical shapes. The toner T (TY, TM, TC, TK) of each color, i.e., yellow (TY), magenta (TM), cyan (TC), and black (TK), is housed in the process cartridge 7 of the corresponding color.

The intermediate transfer belt 5 rotates in the direction of an arrow B in FIG. 2 while contacting all of the photosensitive drums 1. The intermediate transfer belt 5 is wound around a plurality of support members (a drive roller 26, a secondary transfer opposing roller 27, and a driven roller 28). Four primary transfer rollers 8 (8Y, 8M, 8C, 8K) are arranged side by side opposite the respective photosensitive drums 1 on an inner peripheral surface side of the intermediate transfer belt 5 as primary transfer means. Further, a secondary transfer roller 9 is disposed in a position opposite the secondary transfer opposing roller 27 on an outer peripheral surface side of the intermediate transfer belt 5 as secondary transfer means.

Image Forming Process

During image formation, first, the surface of each photosensitive drum 1 is uniformly charged by the charging roller 2. Next, the surface of the charged photosensitive drum 1 is scanned and exposed by a laser beam corresponding to image information and emitted from the scanner unit 3, whereby an electrostatic latent image corresponding to the image information is formed on the photosensitive drum 1. The electrostatic latent image formed on the photosensitive drum 1 is developed as a toner image by the developing unit 4. The toner image formed on the photosensitive drum 1 is then transferred (primary transfer) onto the intermediate transfer belt 5 by an action of the primary transfer roller 8.

During formation of a full color image, for example, the process described above is performed in sequence in each of the first to fourth image forming portions SY, SM, SC, SK, whereupon primary transfer is performed to superimpose the toner images of the respective colors in sequence onto the intermediate transfer belt 5. The recording material 12 is then conveyed to a secondary transfer portion in synchronization with the movement of the intermediate transfer belt 5. The toner images in four colors on the intermediate transfer belt 5 are then transferred, through secondary transfer, onto the recording material 12 all at once by the action of the secondary transfer roller 9, which contacts the intermediate transfer belt 5 through the recording material 12.

The recording material 12 onto which the toner images have been transferred is then conveyed to a fixing apparatus 10 serving as fixing means. In the fixing apparatus 10, the toner images are fixed on the recording material 12 by applying heat and pressure to the recording material 12. Primary transfer residual toner remaining on the photosensitive drums 1 after the primary transfer process is removed by the cleaning blade 6. Further, secondary transfer residual toner remaining on the intermediate transfer belt 5 after the secondary transfer process is removed by an intermediate transfer belt cleaning apparatus 11. The removed secondary transfer residual toner is discharged to a waste toner box (not shown) of the image forming apparatus 100.

Note that the image forming apparatus 100 is also capable of forming single-color or multicolor images using one or several (but not all) of the image forming portions SY, SM, SC, and SK as desired.

Process Cartridge

Figure 7:
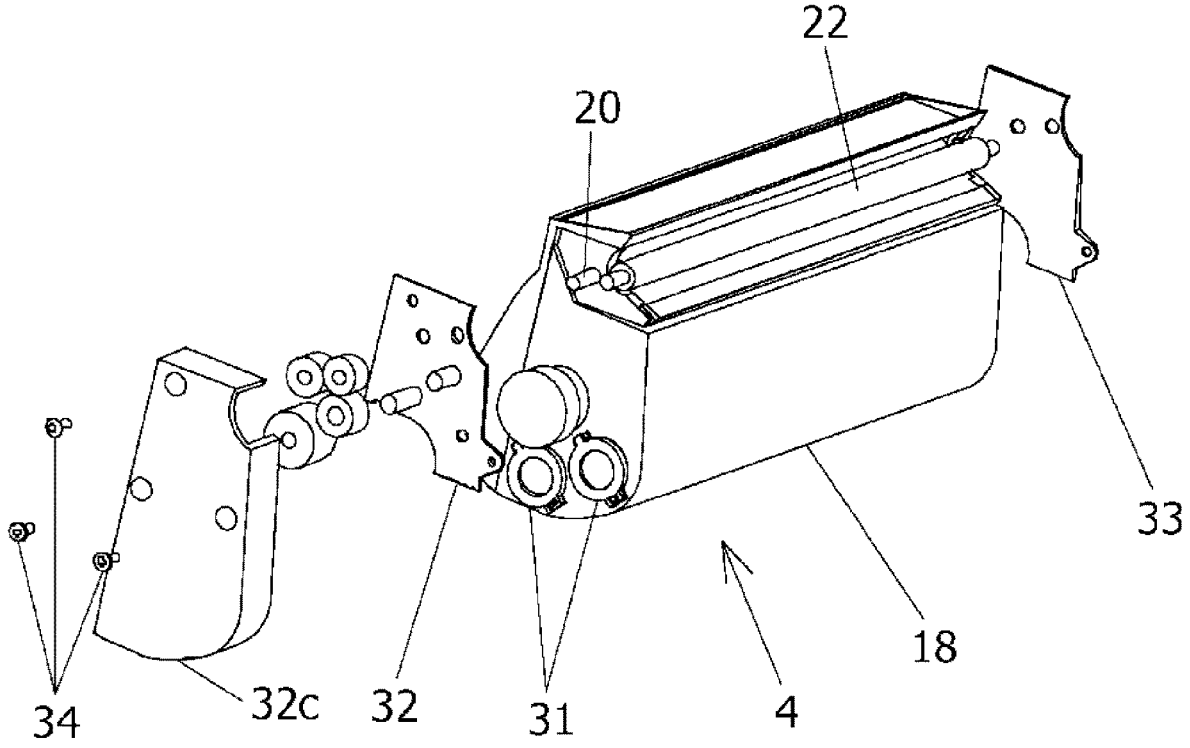
FIG. 7 is an exploded view showing a configuration of a developer container according to the first embodiment.

Next, the overall configuration of the process cartridge 7 attached to the image forming apparatus 100 according to this embodiment will be described using FIGS. 4 and 7. FIG. 7 is an exploded view of the developing unit 4. As shown in FIG. 4, the photosensitive member unit 13 includes a drum frame 14 for supporting various elements within the photosensitive member unit 13. The photosensitive drum 1 is attached to the drum frame 14 via a bearing member so as to be capable of rotating in the direction of an arrow A. The drum frame 14 serves as an example of a frame.

Further, a charging roller bearing 15 is attached to the drum frame 14 along a line passing through a rotary center of the charging roller 2 and a rotary center of the photosensitive drum 1. Here, the charging roller bearing 15 is attached to be capable of moving in the direction of an arrow C. The charging roller 2 is attached rotatably to the charging roller bearing 15. The charging roller bearing 15 is biased toward the photosensitive drum 1 by a charging roller pressurizing spring 16 serving as biasing means.

Furthermore, in the cleaning blade 6, an elastic member 6*a* for removing the primary transfer residual toner remaining on the surface of the photosensitive drum 1 after the primary transfer and a support member 6*b* for supporting the elastic member 6*a* are formed integrally. The primary transfer residual toner removed from the surface of the photosensitive drum 1 by the cleaning blade 6 drops down in the direction of gravity (a downward direction in the figure) through a space formed by the cleaning blade 6 and the drum frame 14 and is housed in the waste toner housing portion 14*a*.

As shown in FIG. 7, the developing unit 4 includes a developing frame 18 that supports the various elements in the developing unit 4 and serves as a developer container. The developing roller 22, which rotates in the direction of an arrow D while contacting the photosensitive drum 1, is provided in the developing unit 4. The developing roller 22 is supported by the developing frame 18 rotatably via bearing units 32, 33 on respective end portions of the developing roller 22 in a rotary axis direction of developing roller 22. The developing roller 22 supplies toner to the photosensitive drum 1. The developing roller 22 serves as an example of a rotary body. The developing frame 18 serves as an example of a frame. Further, the bearing units 32, 33 may also be regarded as parts of the developing frame 18.

The developing unit 4 also includes a developer housing portion 18*a* for housing the toner, a developing portion 18*b* in which the developing roller 22 is disposed, and an opening 18*c* connecting the developer housing portion 18*a* to the developing portion 18*b*. In this embodiment, the developing portion 18*b* is positioned above the developer housing portion 18*a*. A developer supply member 20 that rotates while contacting the developing roller 22 and a developer control member 21 for controlling the thickness of a toner layer formed on the developing roller 22 are disposed in the developing portion 18*b*.

Moreover, a stirring member 23 is provided in the developer housing portion 18*a* of the developing frame 18 to stir the housed toner T and convey the toner to the developer supply member 20 through the opening 18*c*. The stirring member 23 includes a rotary shaft 23*a* that extends in a rotary axis direction thereof, and a flexible stirring sheet 23*b* attached to the rotary shaft 23*a* at one end in order to stir and convey the toner.

The stirring member 23 rotates in the direction of an arrow F in a state where the stirring sheet 23*b* contacts an inner wall surface of the developer housing portion 18*a* so as to bend. The developer housing portion 18*a* includes a release portion 18*e* for releasing the stirring sheet 23*b* from the bent state. The release portion 18*e* is provided in a release position in which the stirring sheet 23*b* is released from the bent state. When the stirring sheet 23*b* passes the release portion 18*e*, the toner carried on the stirring sheet 23*b* is thrown up by the force for releasing the stirring sheet 23*b* from the bent state and conveyed to the developer supply member 20 in the developing portion 18*b* through the opening 18*c*.

Figure 4:
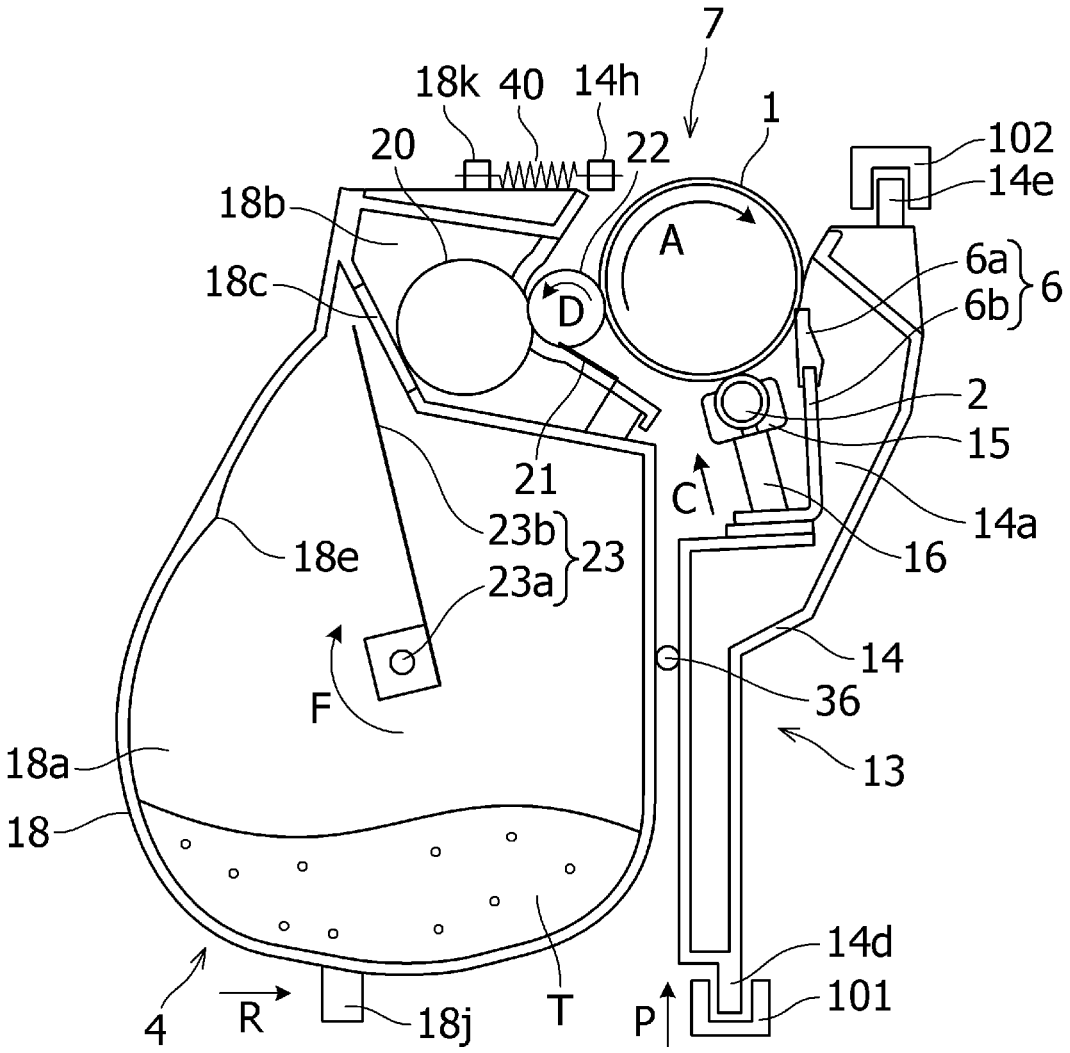
FIG. 4 is a sectional view of the process cartridge according to the first embodiment.

As shown in FIG. 4, the photosensitive member unit (a first unit) 13 and the developing unit (a second unit) 4 are joined by joining pins 36. The developing unit 4 is joined to be capable of moving relative to the photosensitive member unit 13. More specifically, the developing unit 4 is joined to be capable of rotating relative to the photosensitive member unit 13 about the joining pins 36. A boss 14*h* and a boss 18*k* are provided on the drum frame 14 and the developing frame 18, respectively, and a tension spring 40 is engaged with the boss 18*k* and the boss 14*h*. During image formation, the developing unit 4 receives a moment for rotating relative to the photosensitive member unit 13 about the joining pins 36 from the biasing force of the tension spring 40, and as a result, the photosensitive drum 1 and the developing roller 22 come into contact. When image formation is complete, a main body member (not shown) pushes a separating portion 18*j* provided on the developing frame 18 in the direction of an arrow R. Accordingly, the developing unit 4 rotates about the joining pins 36 relative to the photosensitive member unit 13 such that the photosensitive drum 1 and the developing roller 22 separate from each other. Thus, deformation of the developing roller 22 can be suppressed even when the developing roller 22 is left unused for a long period, and as a result, favorable image quality can be obtained.

Figure 5A:
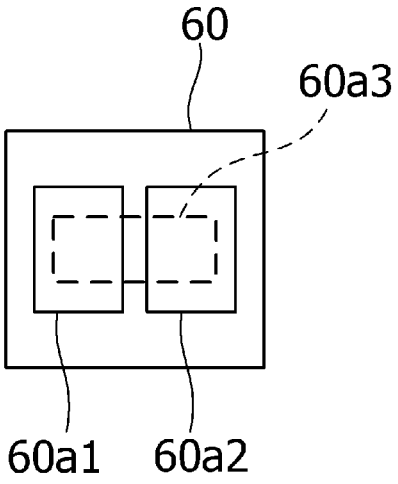
FIGS. 5A and 5B are a front view and a perspective view showing a configuration of a first memory unit according to the first embodiment.
Figure 5B:
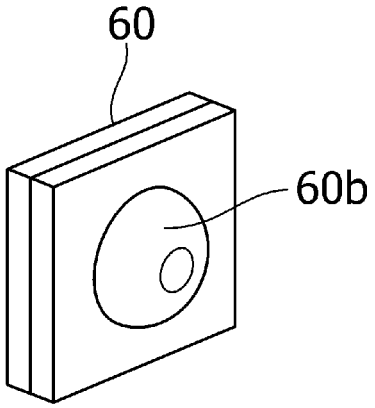
Figure 6C:
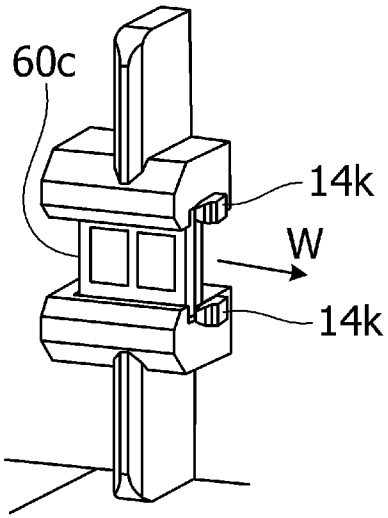
FIGS. 6A to 6C are perspective views showing an attachment configuration of the first memory unit according to the first embodiment.
Figure 6B:
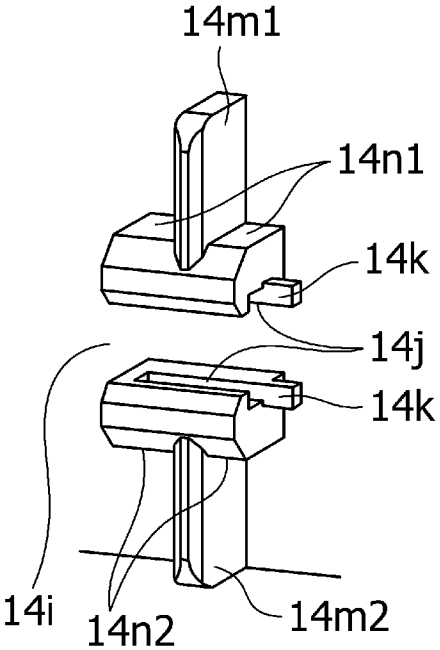
Figure 6A:
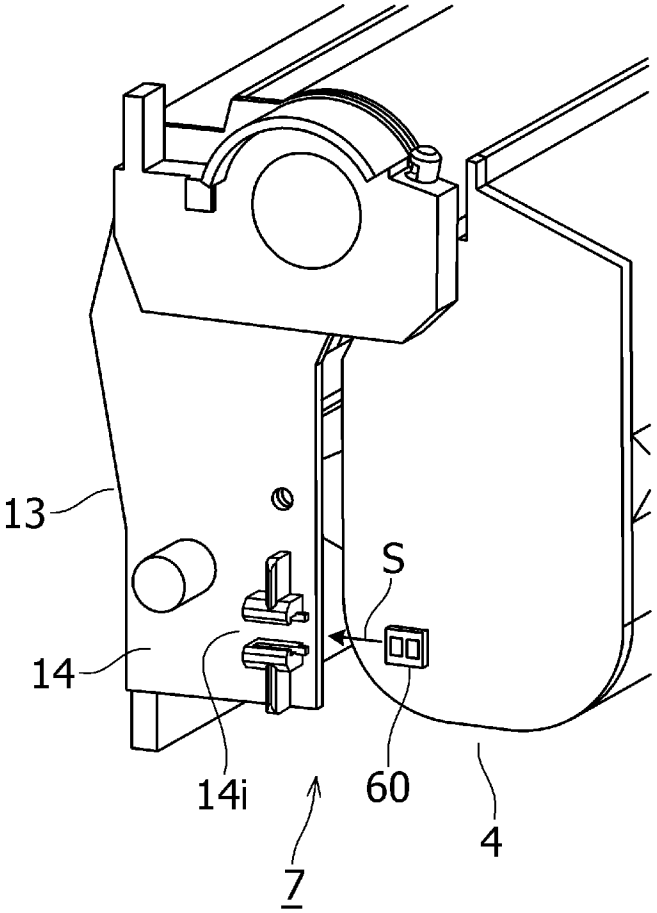

Configuration of First Memory Unit and Attachment Configuration of First Memory Unit Next, a first memory unit (storage means) disposed in the process cartridge will be described using FIGS. 5A to 6C. FIGS. 5A and 5B are a front view and a perspective view of the first memory unit. FIGS. 6A and 6B are perspective views of the process cartridge, showing a state before the first memory unit is inserted into an attachment portion. FIG. 6C is an illustrative view showing a state in which the first memory unit has been inserted into the attachment portion and a rib has been thermally caulked.

Figure 9A:
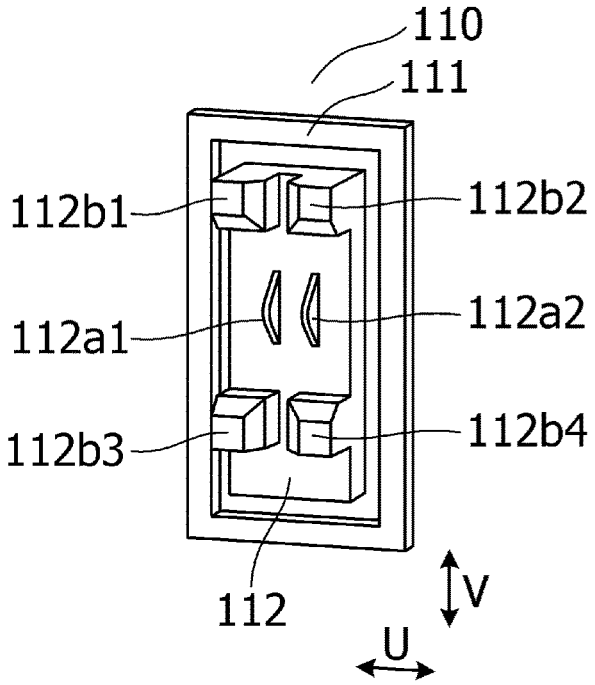
FIG. 9A is a perspective view showing a main body connector unit according to the first embodiment.
Figure 9B:
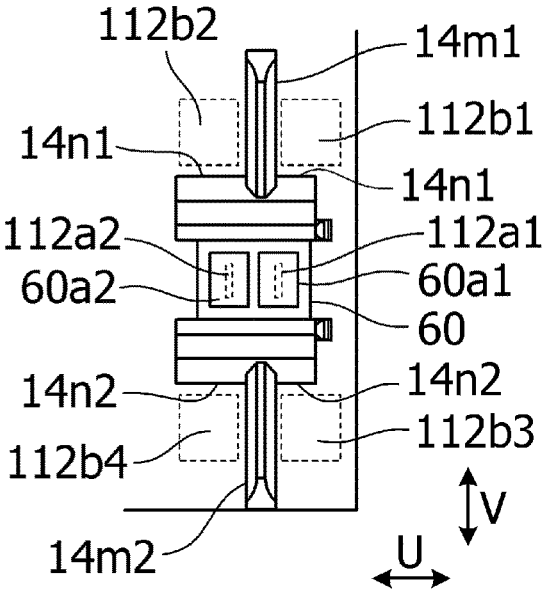
FIG. 9B is a schematic view showing an engagement state between the main body connector unit and an attachment portion, according to the first embodiment.

As shown in FIG. 5A, in memory means (the first memory unit) 60, electrodes 60*a*1, 60*a*2 that can be electrically connected to main body electrodes 112*a*1, 112*a*2, to be described in FIGS. 9A and 9B, are provided on a substrate. Further, a memory chip 60*a*3 serving as a storage element such as a RAM (Random Access Memory) or a ROM (Read-Only Memory) is provided on a rear surface of the electrodes 60*a*1, 60*a*2. FIG. 5B is an external view of the first memory unit 60 in a state where the memory chip 60*a*3 is covered by resin 60*b* or the like. Note that the electrodes 60*a*1, 60*a*2 serve as examples of first electrodes (first memory electrodes or first memory electrical contacts) and the memory chip 60*a*3 serves as an example of a first storage element.

Information used during image formation processing (the lot number of the process cartridge, initial values of processing conditions and so on, a use condition, characteristics of the image forming apparatus, characteristics of the process means, and so on) are stored in advance in the first memory unit 60. When the process cartridge 7 is attached to the image forming apparatus 100, the process cartridge 7 shares the information stored in the first memory unit 60 with the image forming apparatus 100. As a result, a control board (not shown) of the image forming apparatus 100 is notified of states such as the use condition of the process cartridge 7. The image forming apparatus 100 uses the information received from the process cartridge 7 during the image formation processing. For example, the image forming apparatus 100 uses the information to display the state of the process cartridge 7 to an operator. Further, information is written to the memory chip 60*a*3 of the first memory unit 60 as needed while the image forming apparatus 100 is operative.

Next, a method for attaching the first memory unit 60 to the process cartridge 7 will be described. As shown in FIG. 6A, the drum frame 14 is provided with a memory means attachment portion (the attachment portion) 14*i* for attaching the first memory unit 60. Further, as shown in FIG. 6B, the attachment portion 14*i* is provided with a guide portion 14*j* and a caulking boss 14*k*. The first memory unit 60 is inserted along the guide portion 14*j* in the direction of an arrow S and then retained by thermally caulking the caulking boss 14*k*. FIG. 6C shows a state following thermal caulking. The attachment portion 14*i* is further provided with positioning ribs 14*m*1, 14*m*2 and engaging surfaces 14*n*1, 14*n*2 in order to prescribe the position of a connector 112 of the image forming apparatus 100, to be described in FIG. 9A.

Attachment and Detachment of Process Cartridge

Figure 8:
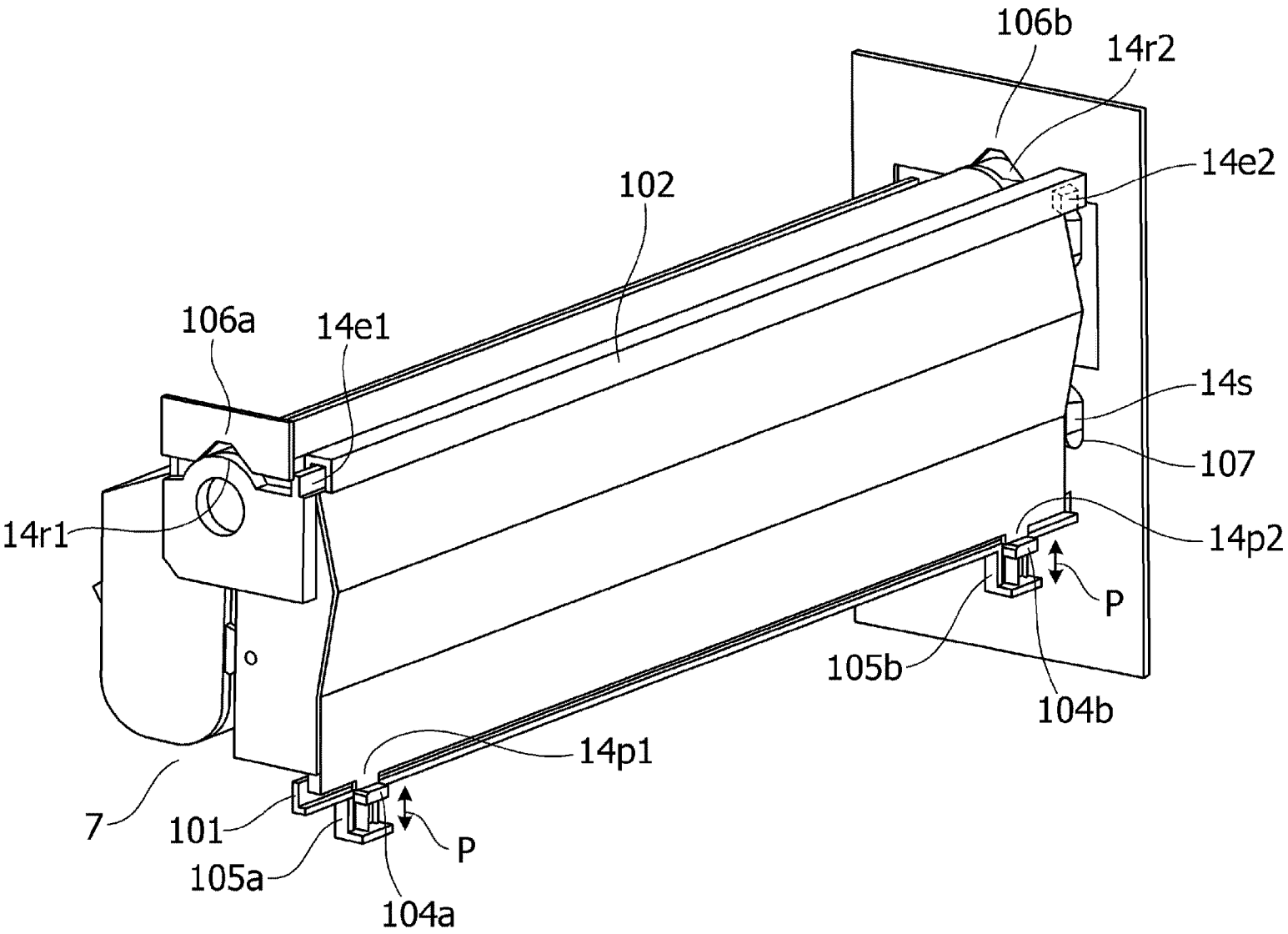
FIG. 8 is a perspective view on which the process cartridge is positioned in the electrophotographic image forming apparatus according to the first embodiment.

A configuration for attaching and detaching the process cartridge 7 to and from the image forming apparatus 100 will now be described with reference to FIGS. 3, 4, and 8. FIG. 8 is a schematic perspective view showing a configuration for positioning the process cartridge 7 in the image forming apparatus 100.

As shown in FIG. 3, the process cartridge 7 is attached to and detached from the image forming apparatus 100 in the axial direction of the photosensitive drum 1 (the direction of the arrow G). Here, an upstream side and a downstream side of an attachment direction of the process cartridge 7 are defined respectively as a near side and a far side. Further, as shown in FIG. 4, a concave first guide 101 and a concave second guide 102 extending in an attachment/detachment direction are provided respectively on a vertical direction lower side and a vertical direction upper side of the image forming apparatus 100. Meanwhile, a first guided portion 14*d* is provided on the drum frame 14 of the photosensitive member unit 13 in a position corresponding to the first guide 101. Further, convex second guided portions 14*e* are provided on respective longitudinal ends in positions corresponding to the second guide 102. When the first guided portion 14*d* and the second guided portions 14*e* respectively contact the first guide 101 and the second guide 102 so as to be restricted thereby, vertical direction and horizontal direction attitudes of the process cartridge 7 are prescribed during attachment and detachment.

Positioning of Process Cartridge

Next, a configuration for positioning the process cartridge 7 will be described using FIGS. 3 and 8. The first guide 101 provided on the image forming apparatus 100 is a configuration that moves in an up-down direction in conjunction with an opening/closing operation (in the direction of an arrow H in FIG. 3) of a main body door 103. As shown in FIG. 8, pushing members 104*a*, 104*b* are provided respectively on the far side and the near side of the first guide 101. The pushing members 104*a*, 104*b* are capable of sliding in the up-down direction (the direction of an arrow P in FIG. 8) relative to the first guide 101 and are biased in an upward direction by biasing means 105*a*, 105*b* such as compression springs. Further, V-shaped positioning portions 106*a*, 106*b* are provided respectively on the far side and the near side of the image forming apparatus 100. Furthermore, a hole portion 107 in the shape of an elongated round hole extending in an up-down movement direction of the first guide 101 is provided on the far side.

Meanwhile, reception portions 14*p*1, 14*p*2 are provided on the process cartridge 7 respectively on the far side and the near side of the drum frame 14. Furthermore, rounded restricting portions 14*r*1, 14*r*2 are provided respectively on the far side and the near side of the photosensitive member unit 13. Finally, a cylindrical rotation-stopping boss 14*s* is provided on the far side of the photosensitive member unit 13. When the process cartridge 7 is attached in the axial direction of the photosensitive drum 1, as described above, the rotation-stopping boss 14*s* of the drum frame 14 is fitted into the hole portion 107. Next, in response to a closing operation of the main body door 103, the first guide 101 moves upward. At this time, the pushing members 104*a*, 104*b* push the reception portions 14*p*1, 14*p*2 upward using the biasing force of the biasing means 105*a*, 105*b*. Accordingly, the restricting portions 14*r*1, 14*r*2 of the drum frame 14 impinge on the positioning portions 106*a*, 106*b* of the image forming apparatus 100 and the rotation-stopping boss 14*s* engages with the hole portion 107, and as a result, the position of the process cartridge 7 relative to the image forming apparatus 100 is fixed.

Configuration for Connecting Electrical Contacts on Image Forming Apparatus Side to Electrical Contacts on Process Cartridge Side Next, connection of a main body connector unit 110 provided in the image forming apparatus 100 will be described using FIGS. 9A and 9B. FIG. 9A is a perspective view showing the main body connector unit 110, and FIG. 9B is a schematic view showing a state in which the main body connector unit 110 is engaged with the attachment portion 14*i*.

When the process cartridge 7 is attached to the image forming apparatus 100, the main body connector unit 110 is disposed in a position opposing the first memory unit 60 of the process cartridge 7. As shown in FIG. 9A, the main body connector unit 110 includes a housing 111 and the connector 112. The housing 111 is fixed to the image forming apparatus 100 by fixing means such as a screw (not shown). The connector 112 is attached loosely to the housing 111 so as to be capable of moving in a horizontal direction (the direction of an arrow U in FIG. 9A) and a vertical direction (the direction of an arrow V in FIG. 9A). Further, the connector 112 includes the main body electrodes (the main body electrical contacts) 112*a*1, 112*a*2, which are constituted by spring materials and electrically connected to a control substrate on the image forming apparatus 100 side by a wire bundle (not shown). Furthermore, positioning ribs 112*b*1, 112*b*2, 112*b*3, 112*b*4 are provided on the connector 112 to position the connector 112 relative to the image forming apparatus 100.

As shown in FIG. 9B, when the process cartridge 7 is attached to the image forming apparatus 100, the positioning ribs 112*b*1, 112*b*2, 112*b*3, 112*b*4 engage with the positioning ribs 14*m*1, 14*m*2 and the restricting portions 14*r*1, 14*r*2 of the process cartridge 7. The connector 112 then moves relative to the process cartridge 7 in the horizontal direction (the direction of the arrow U) and the vertical direction (the direction of the arrow V). As a result, the electrodes 60*a*1, 60*a*2 and the main body electrodes 112*a*1, 112*a*2 are positioned in a state of mutual contact and electrically connected.

Methods for Disassembling and Remanufacturing Process Cartridge

A method for remanufacturing the process cartridge according to this embodiment includes the following five processes.

(1) A process for separating the photosensitive member unit 13 from the developing unit 4

(2) A process for removing the first memory unit 60

(3) A process for disassembling the developing unit 4, refilling the developing unit 4 with toner, and reassembling the developing unit 4

(4) A process for joining the photosensitive member unit 13 to the developing unit 4

(5) A process for attaching a second memory unit 70

Note that the remanufacturing method according to this embodiment also includes a preparatory process for preparing the process cartridge 7 that is to serve as a source component (material component) before performing the five processes described above. A used process cartridge 7 in which the toner has been consumed by performing image forming operations, for example, is used as the process cartridge 7 that is to serve as the source component. In other words, the remanufacturing method according to this embodiment is a method for producing a new process cartridge (a second process cartridge 7, a cartridge) from the process cartridge 7 (a first process cartridge 7, a source cartridge, a material cartridge) serving as the source component. The new process cartridge produced in this manner can be attached to and detached from the image forming apparatus 100 in the same manner as the process cartridge 7 serving as the source component. The respective processes will be described in sequence below.

(1) Process for Separating Photosensitive Member Unit 13 from Developing Unit 4

Figure 11:
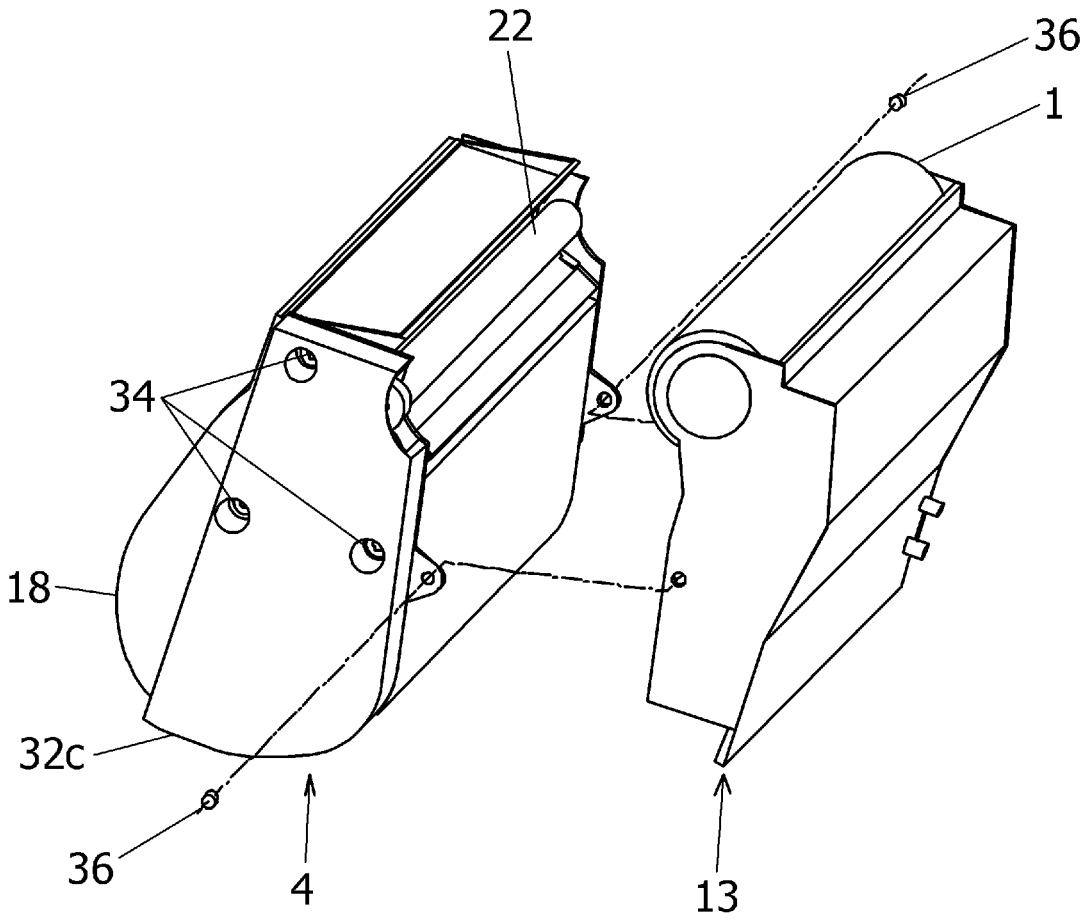
FIG. 11 is a perspective view showing the method for remanufacturing the process cartridge according to the first embodiment.

As shown in FIG. 11, the joining pins 36 provided on the respective ends of the process cartridge 7 are withdrawn, and the photosensitive member unit 13 is separated from the developing unit 4.

(2) Process for Removing First Memory Unit 60

The first memory unit 60 is removed from the photosensitive member unit 13. In this embodiment, the first memory unit 60 is removed from the attachment portion 14*i* by pushing an end surface 60*c* (FIG. 6C) of the first memory unit 60 in an opposite direction (the direction of an arrow W) to the insertion direction. At this time, the boss 14*k*, which is melted by the thermal caulking, breaks. Next, burrs and so on from the broken boss 14*k* are removed, and the attachment portion 14*i* is cleaned by blowing or the like.

(3) Process for Disassembling Developing Unit 4, Refilling Developing Unit 4 with Toner, and Reassembling Developing Unit 4

Figure 12:
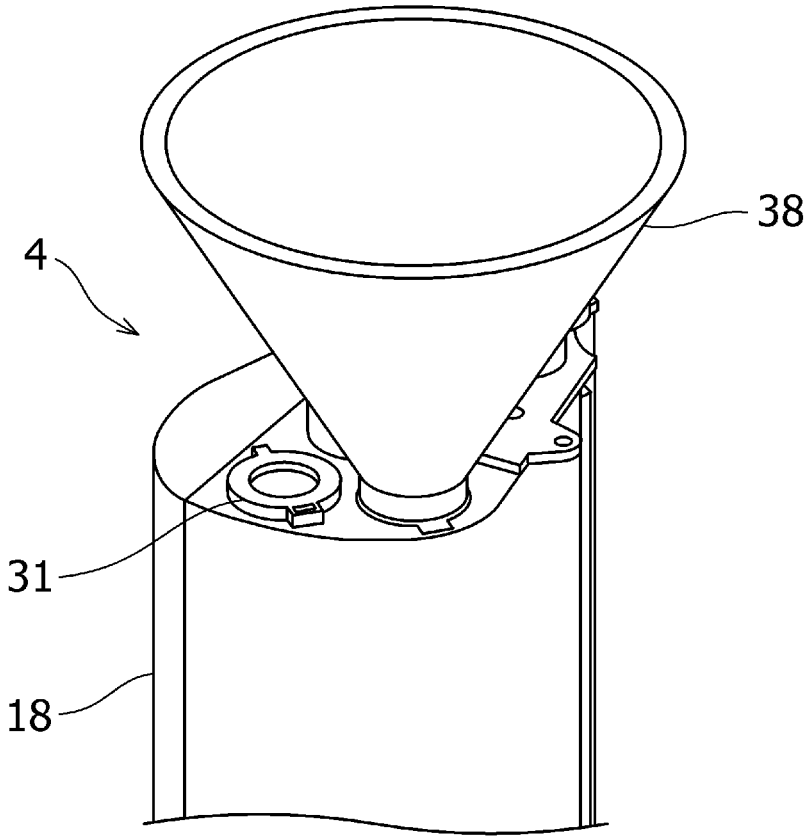
FIG. 12 is a perspective view showing the method for remanufacturing the process cartridge according to the first embodiment.

Three screws 34 shown in FIG. 7 are removed by a screwdriver or the like, whereupon a side cover 32*c* is removed. Next, a toner cap 31 is removed, whereupon a funnel 38 is inserted into an exposed toner filling port, as shown in FIG. 12. The developer housing portion 18*a* is then refilled with toner through the funnel 38. Next, the toner cap is attached using an adhesive or the like, whereupon the removed side cover 32*c* is attached to the developing unit 4 by performing procedures in reverse to those described above.

(4) Process for Recoupling Photosensitive Member Unit 13 to Developing Unit 4

The photosensitive member unit 13 separated in process (1), described above, and the developing unit 4 refilled with toner are recoupled by performing procedures in reverse to those of process (1).

(5) Process for Attaching Second Memory Unit

Configuration of Second Memory Unit

Figure 10A:
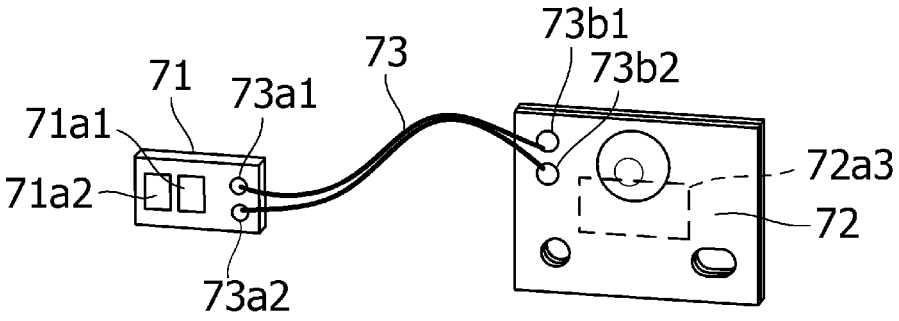
FIGS. 10A to 10C are perspective views showing a method for remanufacturing the process cartridge according to the first embodiment.
Figure 10B:
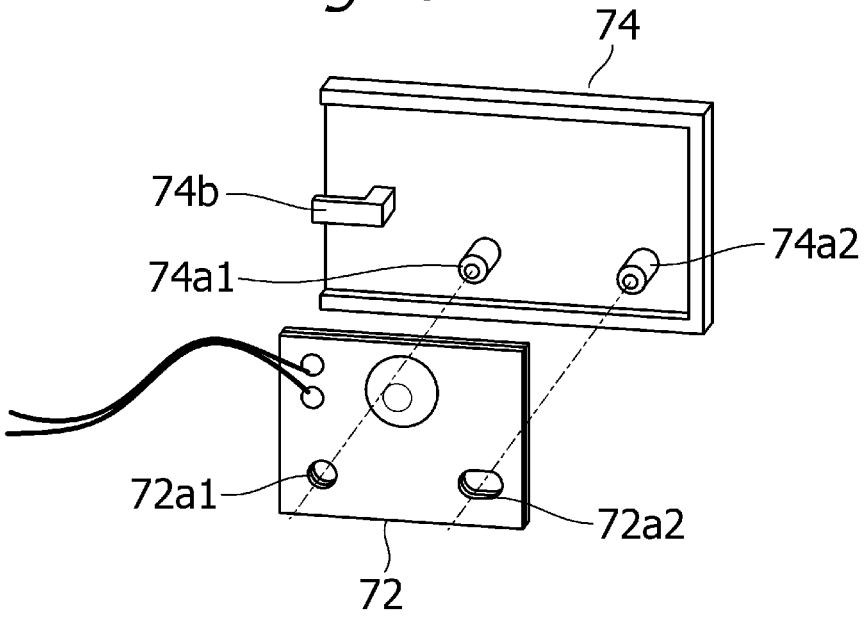
Figure 10C:
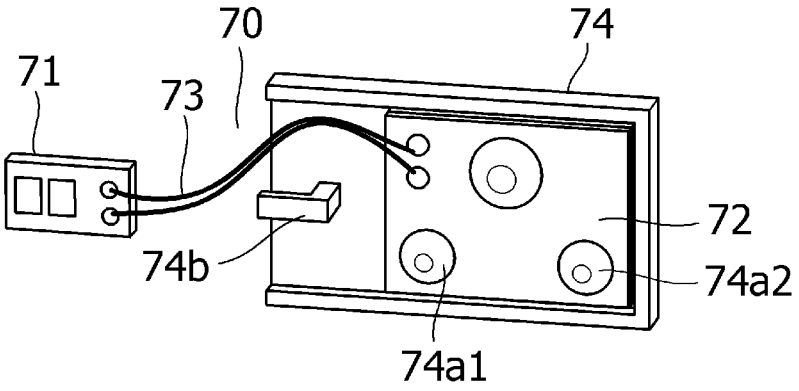

Here, the configuration of the second memory unit 70 that replaces the first memory unit 60 in the process cartridge remanufacturing method according to this embodiment will be described using FIGS. 10A to 10C. FIGS. 10A to 10C are perspective views showing the configuration of the second memory unit 70.

In the first memory unit 60, the electrodes 60*a*1, 60*a*2 and the memory chip 60*a*3 are disposed on a single substrate. The second memory unit 70 has a different shape to the first memory unit 60. More specifically, as shown in FIG. 10A, the second memory unit 70 includes a contact board 71 having electrodes 71*a*1, 71*a*2 capable of contacting the main body electrodes 112*a*1, 112*a*2 on the image forming apparatus 100 side. Further, the second memory unit 70 includes a memory board 72 on which a memory chip 72*a*3 such as a RAM or a ROM is disposed. Furthermore, the second memory unit 70 includes a conductive cable 73 for electrically connecting the contact board 71 to the memory board 72. Note that the conductive cable 73 serves as an example of a connecting member, the electrodes 71*a*1, 71*a*2 serve as examples of second electrodes (second memory electrodes or second memory electrical contacts), and the memory chip 72*a*3 serves as an example of a second storage element.

Here, a component having a different shape and a different size to the component (the substrate of the first memory unit 60) attached prior to implementation of the remanufacturing method according to this embodiment is used as the memory board 72. In this embodiment, a large memory board having a different shape to the substrate attached prior to remanufacturing is used. Therefore, the memory board 72 cannot be attached to the attachment portion 14*i* described above.

The conductive cable 73 is fixed by soldering or the like to connection portions 73*a*1, 73*a*2 on the contact board 71 and connection portions 73*b*1, 73*b*2 on the memory board 72. As a result, the electrodes 71*a*1, 71*a*2 and the memory chip 72*a*3 are electrically connected. Further, the conductive cable 73 is flexible. Therefore, when the photosensitive drum 1 and the developing unit 4 move relative to each other, the conductive cable 73 can deform while maintaining the electrical connections of the connection portions 73*a*1, 73*a*2, 73*b*1, 73*b*2.

Furthermore, as shown in FIG. 10B, positioning holes 72*a*1, 72*a*2 are provided in the memory board 72, while positioning bosses 74*a*1, 74*a*2 are provided on an attachment base 74 in positions corresponding to the positioning holes 72*a*1, 72*a*2. The positioning bosses 74*a*1, 74*a*2 are inserted into the positioning holes 72*a*1, 72*a*2 in the memory board 72. Then, by thermally caulking the positioning bosses 74*a*1, 74*a*2, as shown in FIG. 10C, the memory board 72 is fixed to the attachment base 74. Thus, a component integrating the contact board 71, the memory board 72, the conductive cable 73, and the attachment base 74 serves as an example of the second memory unit 70.

Further, a hook-shaped conductive cable holding portion 74*b* is provided on the attachment base 74. In this embodiment, thermal caulking is used as the method for fixing the memory board 72 to the attachment base 74, but the memory board 72 may be fixed to the attachment base 74 by adhesion, press-fitting, snap-fitting, or the like.

Method for Attaching Second Memory Unit

Figure 1B:
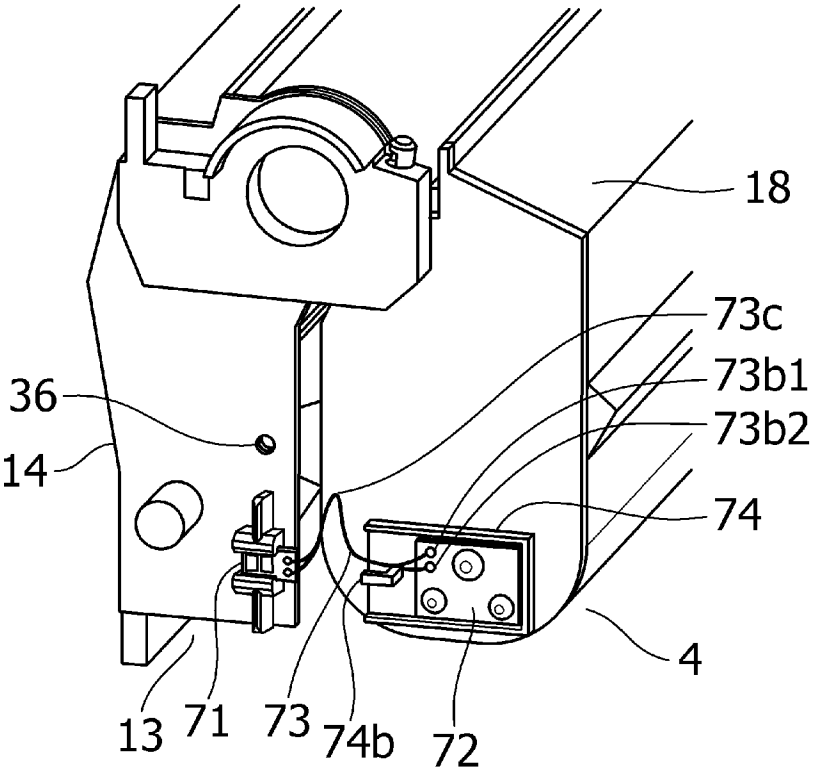
FIGS. 1A and 1B are perspective views showing a remanufacturing method for remanufacturing a process cartridge, according to a first embodiment.
Figure 1A:
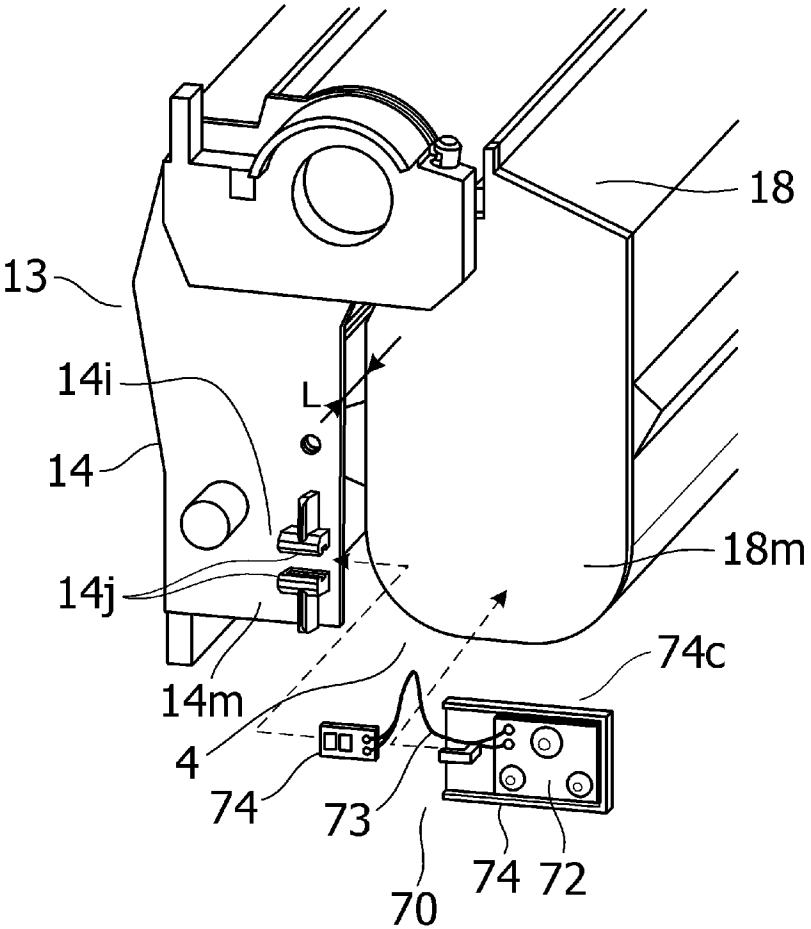

Next, a method for attaching the second memory unit 70 to the process cartridge 7 will be described. FIGS. 1A and 1B are schematic perspective views of the process cartridge 7.

In this embodiment, the electrodes 71*a*1, 71*a*2 are attached to the photosensitive member unit 13, and the memory chip 72*a*3 is attached to the developing unit 4.

As shown in FIG. 1A, the contact board 71 of the second memory unit 70 is inserted into the guide portion 14*j* provided on the attachment portion 14*i* of the drum frame 14. In other words, in this embodiment, the electrodes 71*a*1, 71*a*2 are fixed to the drum frame 14 via the attachment portion 14*i*. At this time, the inserted contact board 71 and the drum frame 14 are fixed to each other by adhesion using an adhesive or the like. Next, an attachment surface 74*c* of the attachment base 74, which is the surface on the opposite side to the surface that contacts the memory board 72, is fixed to a side face 18*m* of the developing frame 18 by an adhesive or the like. In this embodiment, the side face 18*m* of the developing frame 18 is retracted by a predetermined length from a side face 14*m* of the drum frame 14 toward the center of the developing unit 4 in an extension direction of the joining pins 36, or in other words an extension direction of the respective rotary axes of the photosensitive member unit 13 and the developing unit 4. In FIG. 1A, this length is denoted by "L". As a result, a space for attaching the attachment base 74 and laying the conductive cable 73 for connecting the contact board 71 to the memory board 72 can be secured on the side of the side face 18*m*. In other words, the memory chip 72*a*3 is attached to the drum frame 14 in a position on the inside of the attachment portion 14*i* in the direction of the axis on which the developing unit 4 rotates relative to the photosensitive member unit 13. In this embodiment, this space can be used to improve the degree of freedom in the attachment position of the second memory unit 70.

Note that although in this embodiment, an adhesive is used as the method for fixing the attachment base 74 to the developing frame 18, the present invention is not limited thereto, and welding or a thermoplastic resin (hot melt), for example, may be used instead. Also note that the attachment base 74 serves as an example of a storage element attachment portion for attaching the storage element of the second memory unit.

Further, in a state where the contact board 71 and the drum frame 14 are fixed to each other and the attachment base 74 is fixed to the developing frame 18, as shown in FIG. 1B, the conductive cable 73 includes a loop-shaped slack portion 73*c*.

As described above, the developing unit 4 moves relative to the photosensitive member unit 13 about the joining pins 36. At this time, the slack portion 73*c* of the conductive cable 73 deforms in accordance with the movement of the developing unit 4. Here, the hook-shaped conductive cable holding portion 74*b* is provided on the attachment base 74 (FIG. 1B). The conductive cable 73 is wound at least once around the conductive cable holding portion 74*b*. Thus, when the developing unit 4 moves relative to the photosensitive member unit 13 in the manner described above, a load is unlikely to act directly on the connection portions 73*b*1, 73*b*2 between the memory board 72 and the conductive cable 73. As a result, an effect of preventing disconnection of the electrical connections of the connection portions 73*b*1, 73*b*2 when the developing unit 4 repeatedly moves relative to the photosensitive member unit 13, for example, can be expected.

Note that various methods may be used to prevent disconnection of the electrical connections of the connection portions 73*a*1, 73*a*2, 73*b*1, 73*b*2 when the developing unit 4 moves relative to the photosensitive member unit 13. In this embodiment, a method of reinforcing the respective connection portions between the memory board 72 and the conductive cable 73 and between the contact board 71 and the conductive cable 73 by coating the connection portions with thermoplastic resin and curing the resin may be used as one of the various methods.

As described above, the photosensitive member unit 13 includes guides for assisting attachment to and detachment from the image forming apparatus 100 as well as positioning members, rotation-stopping members, and so on, and therefore the space for providing the memory board 72 of the second memory unit 70 may be limited. According to this embodiment, even when the memory board 72 differs from that of the original first memory unit 60 in terms of shape and size such that the space for installing the memory board 72 in the photosensitive member unit 13 may be insufficient, the process cartridge 7 can be remanufactured in the manner described above.

Figure 13C:
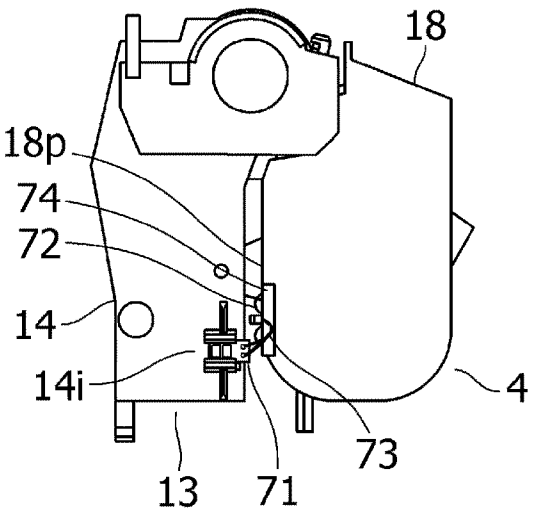
FIGS. 13A to 13C are perspective views showing the method for remanufacturing the process cartridge according to the first embodiment.
Figure 13B:
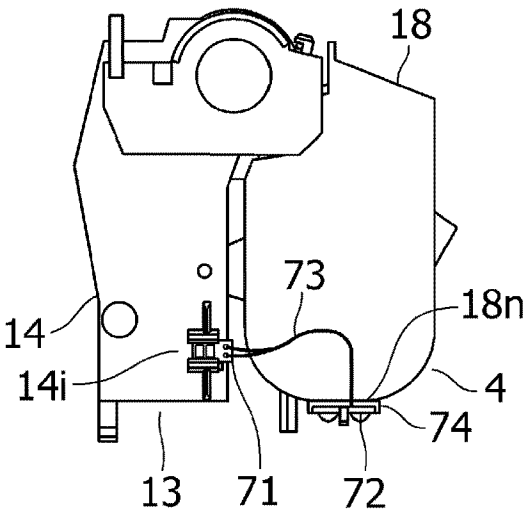
Figure 13A:
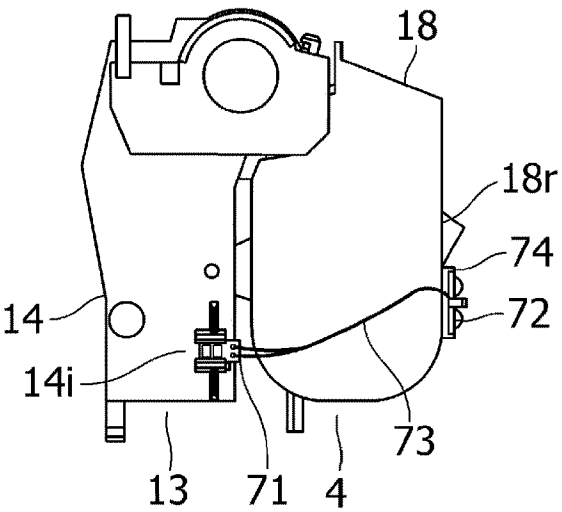

Further, in the above description, the side face 18*m* of the developing frame 18 serves as the attachment position in which the attachment base 74 is attached to the developing frame 18. As shown in FIGS. 13A to 13C, however, any one of a surface 18*n* on a vertical direction lower side of the developing frame 18, a surface 18*p* on the side of the photosensitive member unit 13, and a surface 18*r* on the opposite side to the photosensitive member unit 13 may be set as the attachment position of the attachment base 74. Hence, according to this embodiment, the memory board 72 can be disposed in an installation space in the developing frame 18, leading to an improvement in the degree of freedom with which the memory board 72 is disposed in the developing frame 18.

Furthermore, in this embodiment, the electrodes 71*a*1, 71*a*2 are attached to the photosensitive member unit 13 that is positioned in the image forming apparatus 100, and therefore the electrodes 71*a*1, 71*a*2 can be positioned relative to the main body electrodes 112*a*1, 112*a*2 precisely.

Second Embodiment

Next, using FIGS. 14 and 15, a second embodiment of the present invention will be described. Note that in the second embodiment, parts that differ from the first embodiment will be described in detail. In the following description, unless specified otherwise, materials, shapes, processes, and so on are similar to the first embodiment. Further, identical numerals have been allocated to constituent elements of the second embodiment that correspond to the first embodiment, and detailed description thereof has been omitted.

In this embodiment, a process cartridge remanufacturing method for remanufacturing a process cartridge having a different form to the first embodiment will be described. In the first embodiment, the first memory unit is disposed in the photosensitive member unit, and to attach the second memory unit, the second electrodes are attached to the photosensitive member unit and the second storage element is attached to the developing unit. In this embodiment, the first memory unit is disposed in the developing unit (the second unit), and to attach the second memory unit, the second electrodes are attached to the developing unit and the second storage element is attached to the photosensitive member unit (the first unit).

Figure 14:
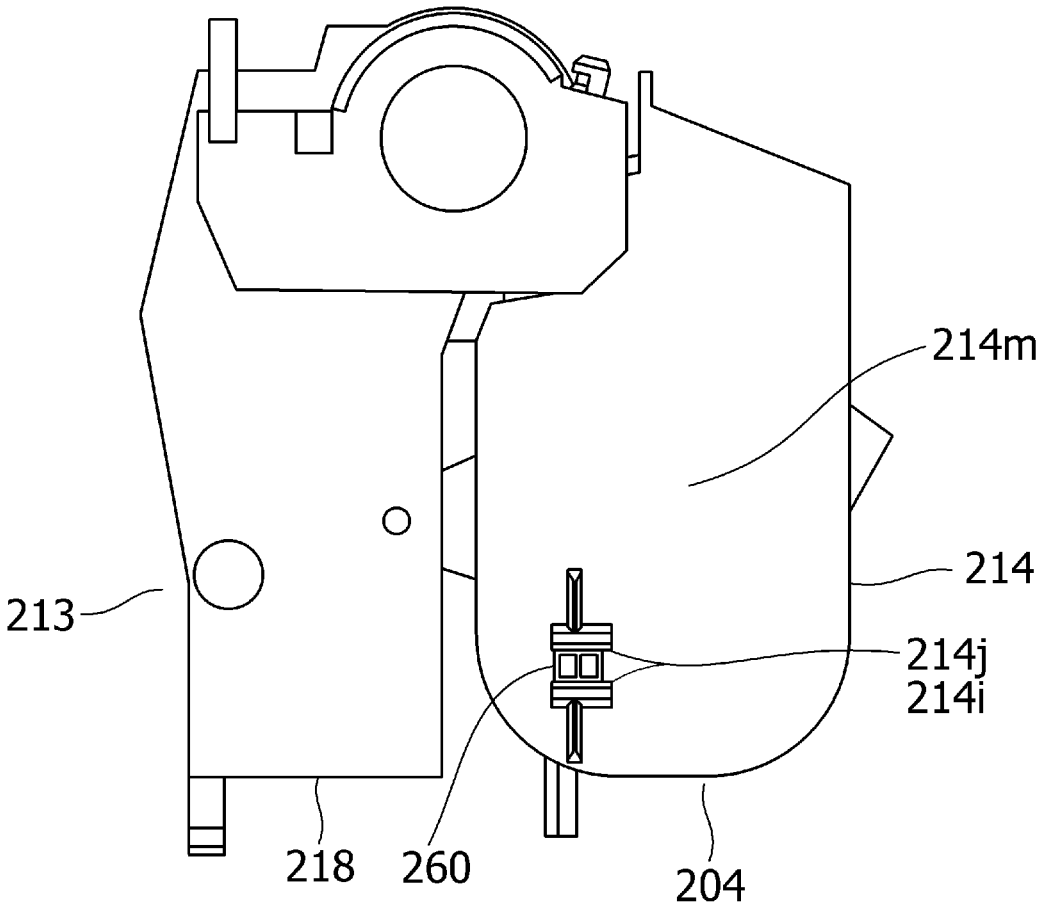
FIG. 14 is a side view of a process cartridge according to a second embodiment.

FIG. 14 is a side view of a process cartridge 213 according to the second embodiment. As shown in FIG. 14, a first memory unit 260 of the process cartridge 213 according to this embodiment is attached to an attachment portion 214*i* on a side face 214*m* of a developing unit 204. Similar methods to those described in the first embodiment are used as the method for attaching the first memory unit 260 to the attachment portion 214*i* and the method for connecting the image forming apparatus 100 to the first memory unit 260. In other words, the main body connector unit 110 described in the first embodiment may be disposed in a position enabling connection to the first memory unit 260.

In the method for remanufacturing the process cartridge 213 according to this embodiment, different processes are executed in processes (2) and (5) of the first embodiment, while all other processes are similar to the first embodiment.

(2-2) Process for Removing First Memory Unit 260

The first memory unit 260 is removed from the attachment portion 214*i* on the side face 214*m* of the developing unit 204. Here, the specific removal method is similar to the first embodiment, and therefore description thereof has been omitted.

(2-5) Process for Attaching Second Memory Unit (Memory Attachment Process)

A method for attaching a second memory unit 270 to the process cartridge 213 will now be described. In this embodiment, the electrodes (the second electrodes) of the second memory unit 270 are attached to the developing unit 204, whereupon the memory chip (the second storage element) of the second memory unit 270 is attached to the photosensitive member unit.

Figure 15:
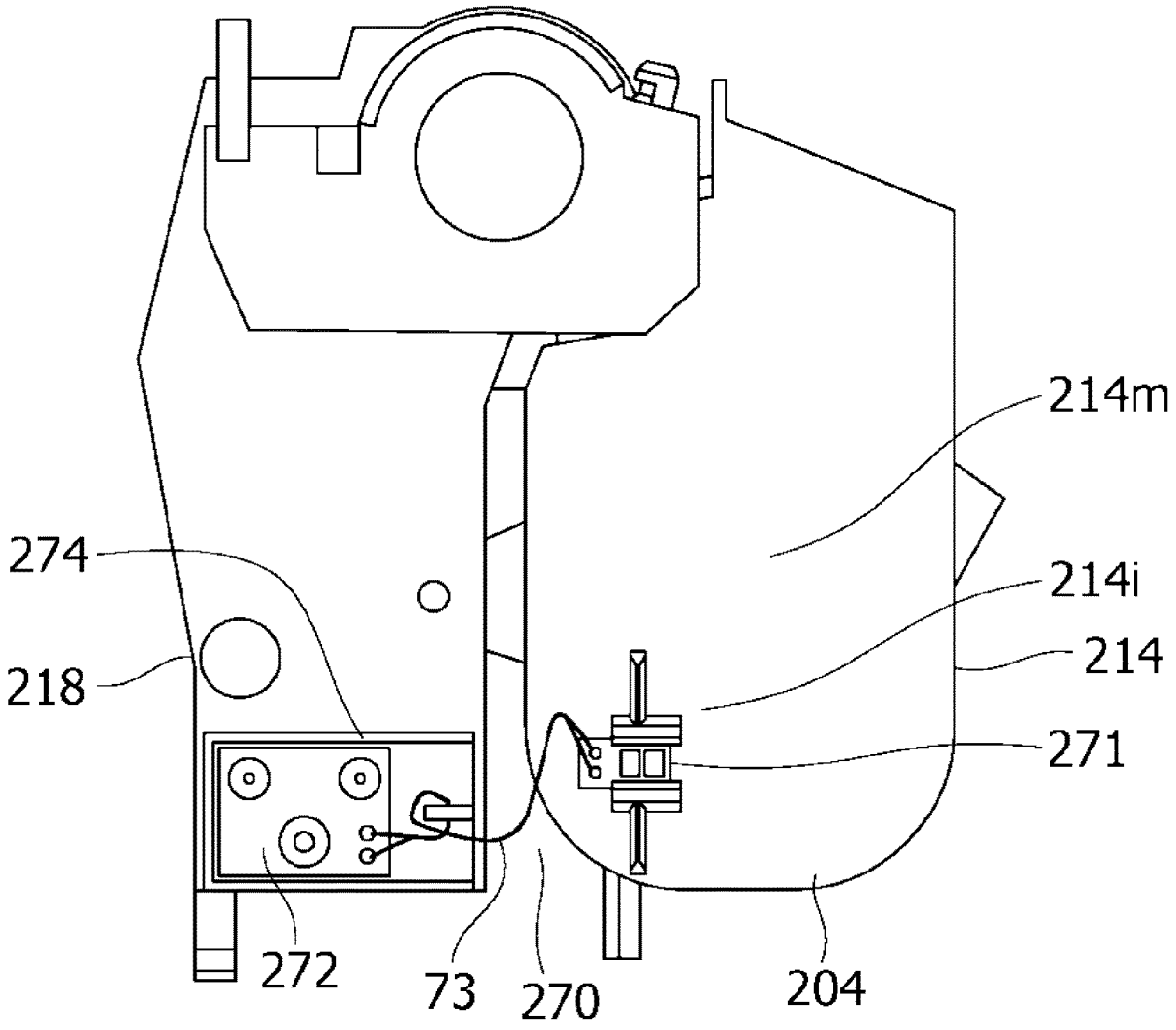
FIG. 15 is a side view showing a method for remanufacturing the process cartridge according to the second embodiment.

FIG. 15 is a side view showing the process cartridge 213 following attachment of the second memory unit 270.

First, a contact board 271 of the second memory unit 270 is inserted into a guide portion 214*j* (see FIG. 14) provided on the attachment portion 214*i* of a developing frame 214. The inserted contact board 271 and the developing frame 214 are fixed to each other by adhesion using an adhesive or the like.

Next, an attachment surface of an attachment base 274, which is a surface on the opposite side to a surface that contacts a memory board 272, is fixed to a drum frame 218 by an adhesive or the like. According to this embodiment, a first memory unit 260 that is attached before implementing the method for remanufacturing the process cartridge 213 can be replaced with the second memory unit 270, which has a different shape and so on to the first memory unit 260, and as a result, similar effects to the first embodiment can be obtained.

According to the present invention, as described above, an attachment portion for attaching the first memory unit, which includes electrodes and a storage element, is provided on one of the photosensitive member unit and the developing unit. Thus, when the first memory unit is replaced with the second memory unit described above, even if it is impossible to attach the storage element of the second memory unit to the attachment portion, the storage element of the second memory unit can be attached to the other of the photosensitive member unit and the developing unit.

In other words, in the process cartridge having the second memory unit described above, the second electrodes of the second memory unit (the memory unit) are disposed on one of the photosensitive member unit and the developing unit. Further, the second storage element is disposed on the other of the photosensitive member unit and the developing unit.

Note that in the embodiments described above, the photosensitive member unit and the developing unit are separated before replacing the first memory unit with the second memory unit. However, the photosensitive member unit and the developing unit do not have to be separated before replacing the first memory unit with the second memory unit.

Further, the conductive cable of the second memory unit may be connected to the second electrodes and the second storage element after attachment of the second electrodes and attachment of the second storage element are complete. At this time, the conductive cable of the second memory unit may be attached after rejoining of the photosensitive member unit and the developing unit is complete. In other words, the process cartridge remanufacturing method may be said to further include a connection process (a conductive cable attachment process) for electrically connecting the second electrodes and the second storage element using the conductive cable.

Third Embodiment

Next, using FIGS. 16 to 19B, a third embodiment of the present invention will be described. Note that in the third embodiment, parts that differ from the first and second embodiments will be described in detail. In the following description, unless specified otherwise, materials, shapes, processes, and so on are similar to the first and second embodiments. Further, identical numerals have been allocated to constituent elements of the third embodiment that correspond to the first and second embodiments, and detailed description thereof has been omitted.

In this embodiment, a cartridge remanufacturing method having a different form to the first embodiment will be described. In the first and second embodiments, the developing unit and the photosensitive member unit are joined movably by the joining pins. In the first embodiment, the first memory unit is disposed in the photosensitive member unit, and to attach the second memory unit, the second electrodes are attached to the photosensitive member unit and the second storage element is attached to the developing unit. In the second embodiment, the first memory unit is disposed in the developing unit, and to attach the second memory unit, the second electrodes are attached to the developing unit and the second storage element is attached to the photosensitive member unit. In this embodiment, two cartridges, namely a developing cartridge and a photosensitive member cartridge, can be attached to and detached from the image forming apparatus independently of each other. The developing cartridge is joined to an end member, to be described below, so that a developing unit is capable of moving, while the photosensitive member cartridge is configured similarly to the photosensitive member unit 13 of the first embodiment. In other words, the process cartridge according to this embodiment includes a developing unit (the developing cartridge) and a photosensitive member unit (the photosensitive member cartridge) that can be attached to and detached from the image forming apparatus independently of each other. Further, the first memory unit is disposed on a first end member, to be described below, and to attach the second memory unit, the second electrodes are attached to the first end member of the developing unit and the second storage element is attached to the developing frame of the developing unit.

Developing Cartridge

Figure 16:
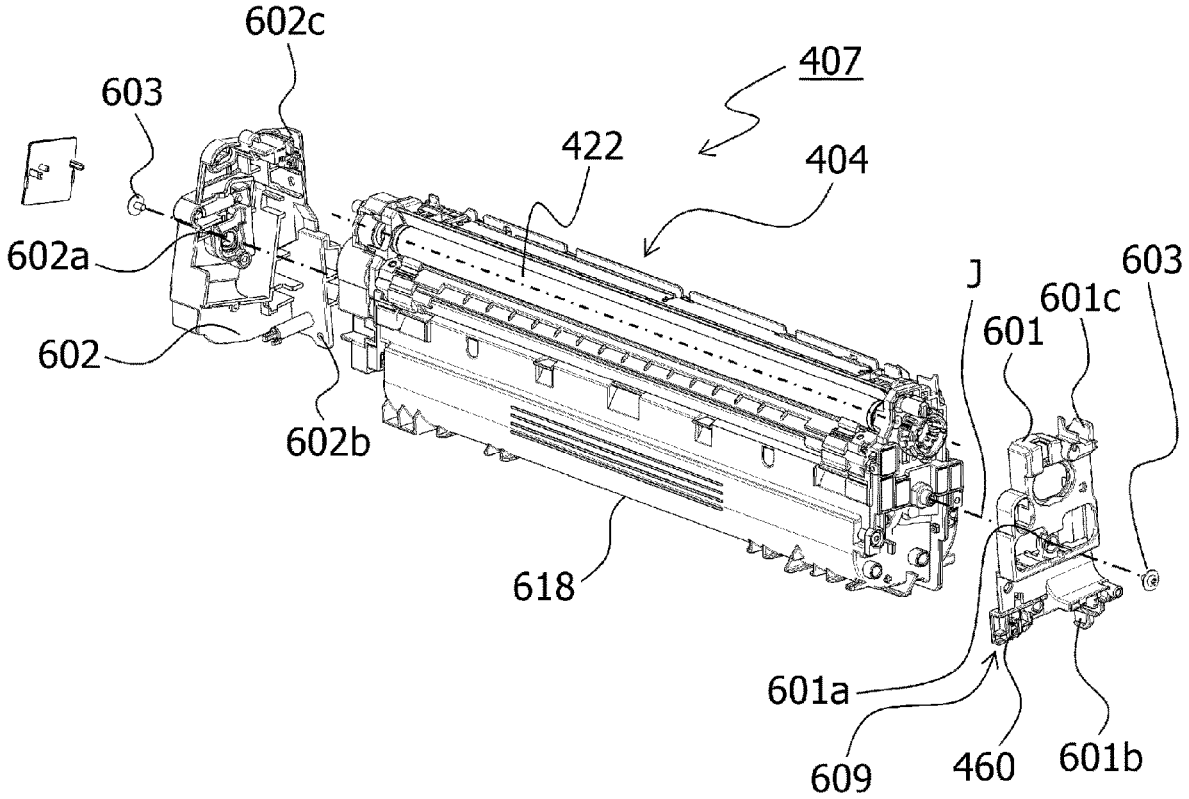
FIG. 16 is an exploded perspective view of a developing cartridge according to a third embodiment.

FIG. 16 is an exploded perspective view of a developing cartridge 407. The developing cartridge 407 includes a developing unit (the second unit) 404 and an end portion unit (the first unit) 609. The developing unit 404 includes a developing frame 618 and a developing roller 422 supported rotatably by the developing frame 618. The developing roller 422 is identical to the developing roller 22 of the first embodiment, and therefore description thereof has been omitted. The end portion unit 609 includes a first memory unit 460, and a first end member (the end member) 601 attached to one end portion of the developing frame 618 in a rotary axis direction of the developing roller 422. Further, the developing cartridge 407 includes a second end member 602 attached to the other end portion of the developing frame 618. The developing roller 422 rotates around a rotary axis (a dotted line in the figure) passing through the center of the developing roller 422. In this embodiment, the rotary axis direction of the developing roller 422 is identical to a longitudinal direction of the developing frame 618. In this embodiment, the developing unit 404 is joined movably to the first end member 601 and the second end member 602, which are provided on respective longitudinal direction end portions of the developing unit 404. The longitudinal direction of the developing unit 404 and the longitudinal direction of the developing frame 618 are parallel to the rotary axis direction of the developing roller 422 provided in the developing unit 404. The first end member 601 and the second end member 602 support the developing frame 618 to be capable of rotating about a rotary axis J that is parallel to the longitudinal direction of the developing frame 618. In other words, the first end member 601 and the second end member 602 are attached rotatably to the developing frame 618. The first end member 601 and the second end member 602 are capable of rotating independently of each other. More specifically, the first end member 601 is capable of rotating relative to the second end member 602 and the developing frame 618, while the second end member 602 is capable of rotating relative to the first end member 601 and the developing frame 618. Accordingly, the developing frame 618 is capable of rotating about the rotary axis J relative to the first end member 601 and the second end member 602. More specifically, the developing frame 618 is supported rotatably by a developing unit support portion 601*a* provided on the first end member 601 and a developing unit support portion 602*a* provided on the second end member 602. When the developing frame 618 rotates, the developing roller 422 moves relative to the first end member 601 and the second end member 602 in a direction that intersects (in this embodiment, is orthogonal to) the rotary axis direction of the developing roller 422. In the developing unit 404, longitudinal direction movement of the developing unit 404 is restricted by falling prevention screws 603. Furthermore, the first memory unit 460 is attached to the first end member 601. The first memory unit 460 is configured similarly to the first memory unit 60 of the first embodiment, and therefore description of the configuration of the first memory unit 460 has been omitted here. Other configurations of the developing cartridge 407 are similar to the configurations of the developing unit 4 of the first embodiment, and therefore description of the other configurations of the developing cartridge 407 has been omitted here.

Figure 17:
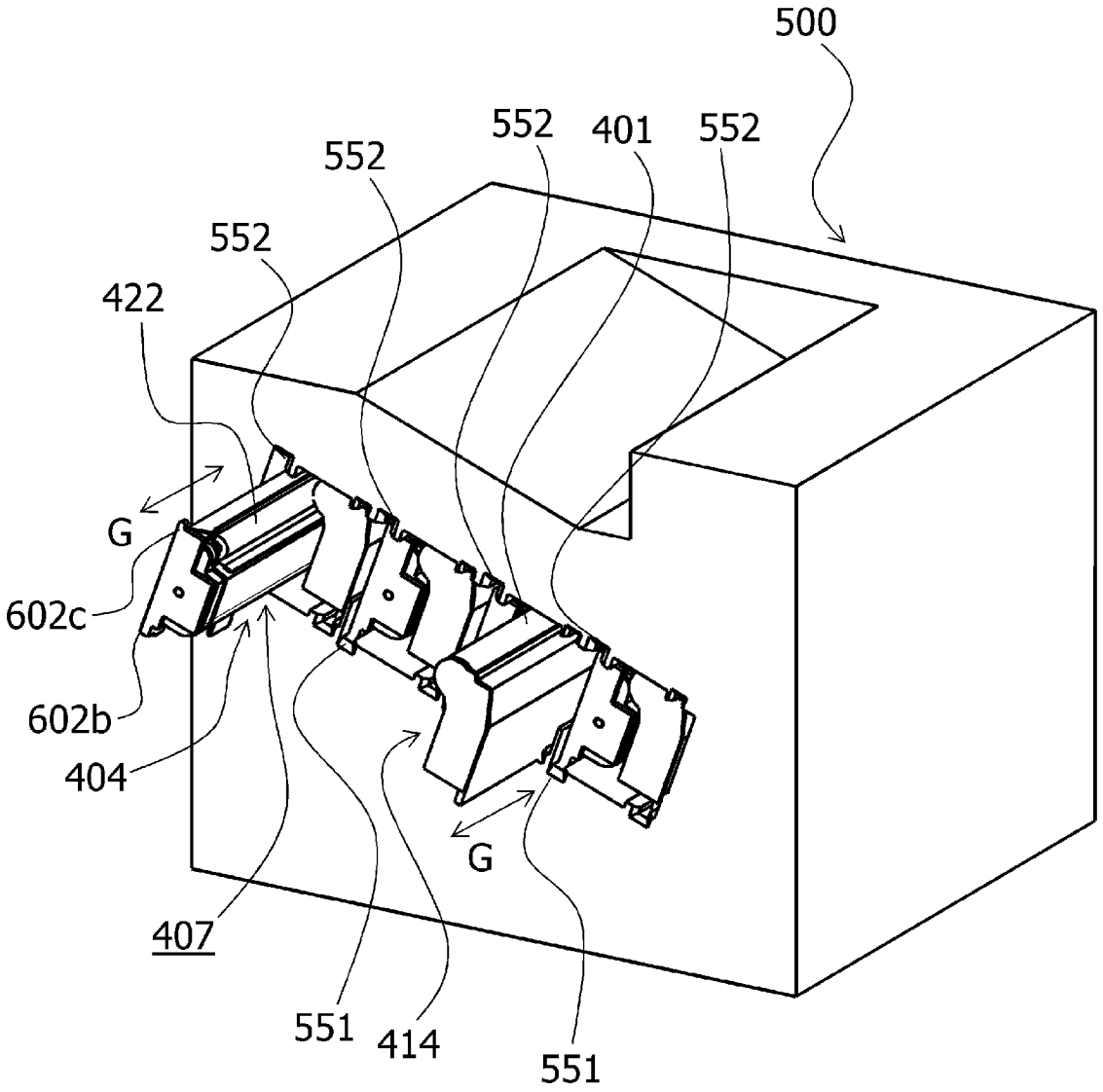
FIG. 17 is a perspective view on which the developing cartridge and a photosensitive member cartridge are attached to an image forming apparatus according to the third embodiment.

Attachment and Detachment of Developing Cartridge and Photosensitive Member Cartridge Using FIG. 17, attachment and detachment of the developing cartridge 407 and the photosensitive member cartridge 414 to and from an image forming apparatus 500 will be described. FIG. 17 is a schematic perspective view showing a state in which the developing cartridge 407 and the photosensitive member cartridge 414 are attached to the image forming apparatus 500 according to this embodiment. As shown in FIG. 17, the developing cartridge 407 and the photosensitive member cartridge 414 are attached to and detached from the image forming apparatus 500 in an axial direction (the direction of an arrow G) of a photosensitive drum 401. Here, an upstream side and a downstream side of an attachment direction of the developing cartridge 407 are defined respectively as a near side and a far side. The developing cartridge 407 is inserted in a state where the first end member 601 is positioned on the far side and the second end member 602 is positioned on the near side. Further, as shown in FIG. 17, concave first developing guides 551 and concave second developing guides 552 extending in an attachment/detachment direction are provided respectively on a vertical direction lower side and a vertical direction upper side of the image forming apparatus 500. Meanwhile, first developing guided portions 601*b*, 602*b* are provided respectively on the first end member 601 and the second end member 602 of the developing cartridge 407 in positions corresponding to the first developing guides 551 (see FIG. 16). Furthermore, convex second guided portions 601*c*, 602*c* are provided respectively on the first end member 601 and the second end member 602 of the developing cartridge 407 in positions corresponding to the second developing guides 552. When the first developing guided portions 601*b*, 602*b* and the second developing guided portions 601*c*, 602*c* respectively contact the first developing guides 551 and the second developing guides 552 so as to be restricted thereby, vertical direction and horizontal direction attitudes of the developing cartridge 407 are prescribed during attachment and detachment.

When the developing cartridge 407 is attached to the image forming apparatus 500, the first end member 601 and the second end member 602 contact and are positioned by the image forming apparatus 500. In a state where the first end member 601 and the second end member 602 are positioned, the developing unit 404 rotates relative to the first end member 601 and the second end member 602 about the rotary axis J.

Further, the specific method for attaching and detaching the photosensitive member cartridge 414 is similar to the first embodiment, and therefore description thereof has been omitted.

Moreover, to remove the developing cartridge 407 and the photosensitive member cartridge 414 from the image forming apparatus 500, the developing cartridge 407 and the photosensitive member cartridge 414 are removed in the opposite direction to the attachment direction.

Methods for Disassembling and Remanufacturing Developing Cartridge

A method for remanufacturing the developing cartridge 407 (the second cartridge, the cartridge) including the second memory unit 470 from the developing cartridge 407 (the first cartridge, the source cartridge) including the second memory unit 460 will now be described. The second memory unit 470 will be described below. In the method for remanufacturing the developing cartridge 407 according to this embodiment, different processes are executed in processes (1), (2), (4), and (5) of the first embodiment, while process (3) is similar to the first embodiment.

(3-1) Process for Separating End Member

In this embodiment, as described above, the developing unit 404 is joined to the first end member 601.

As shown in FIG. 16, the falling prevention screws 603 are removed from the developing unit 404, whereupon the first end member 601 is removed from the developing unit 404.

(3-2) Process for Removing First Memory Unit 460

Figure 18:
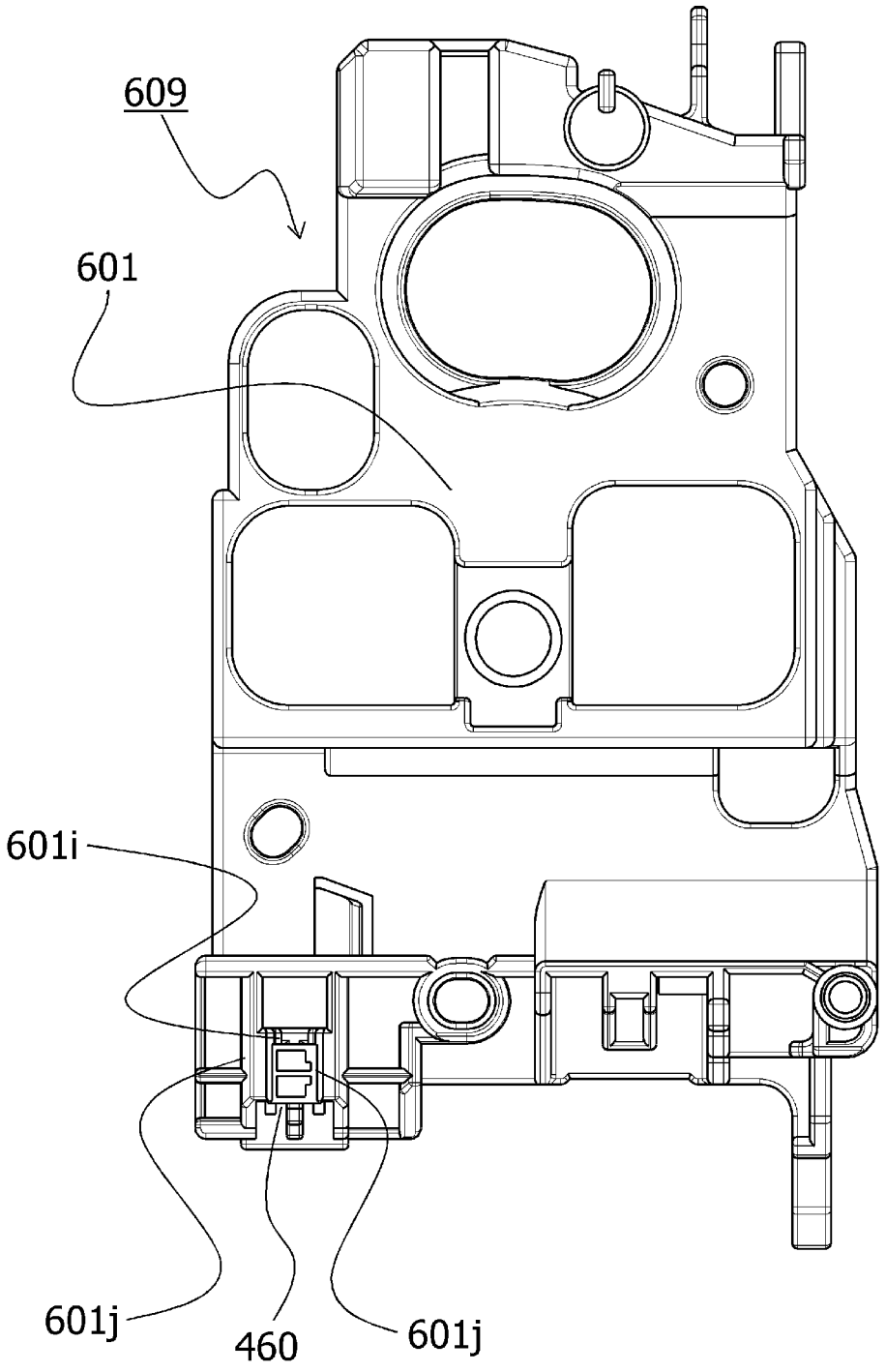
FIG. 18 is a view showing a configuration of an end portion unit according to the third embodiment.

Using FIG. 18, a process for removing the first memory unit 460 from the developing unit 404 will be described. FIG. 18 is a side view showing a configuration of the end portion unit 609. As shown in FIG. 18, the first memory unit 460 is attached to a guide portion 601*j* provided on an attachment portion 601*i* of the first end member 601. The first memory unit 460 is removed from the guide portion 601*j* provided on the attachment portion 601*i* of the first end member 601. The specific method for removing the first memory unit 460 is similar to the method for removing the first memory unit 60 according to the first embodiment, and therefore description thereof has been omitted.

(3-4) Process for Rejoining End Member

The first end member 601 removed in process (3-1) and the developing unit 404 refilled with toner are rejoined by performing reverse procedures to those of process (3-1). Note that the processes for disassembling the developing unit 404, refilling the developing unit 404 with toner, and reassembling the developing unit 404 are similar to the processes of (3) according to the first embodiment, and therefore description thereof has been omitted.

(3-5) Process for Attaching Second Memory Unit (Memory Attachment Method)

A method for attaching the second memory unit 470 to the developing unit 404 of the developing cartridge 407 will now be described. In this embodiment, the electrodes (the second electrodes) of the second memory unit 470 are attached to the first end member 601, and the memory chip (the second storage element) of the second memory unit 470 is attached to the developing unit 404. The second memory unit 470 is configured similarly to the second memory unit 70 of the first embodiment, and therefore description of the configuration of the second memory unit 470 has been omitted here.

Figure 19A:
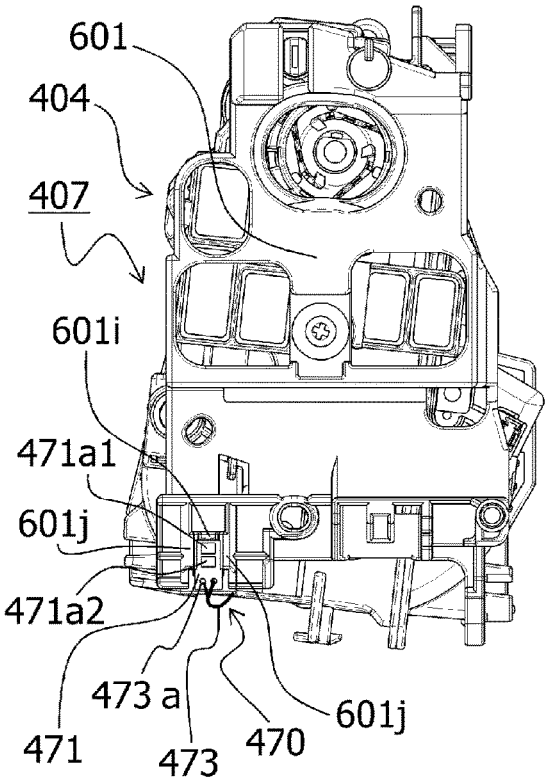
FIGS. 19A and 19B are views showing the developing cartridge with a second memory unit attached thereto, according to the third embodiment.
Figure 19B:
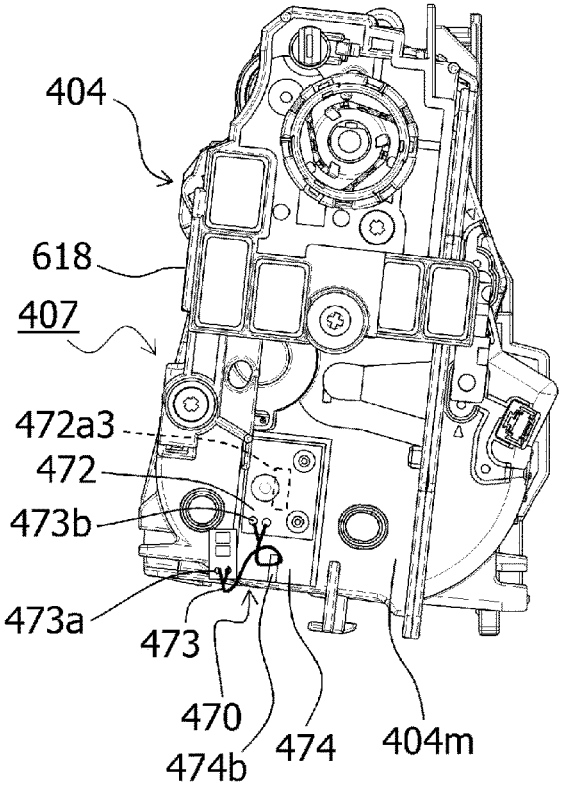

FIGS. 19A and 19B are views showing the developing cartridge 407 following attachment of the second memory unit 470. FIG. 19A is a side view of the developing cartridge (the second cartridge, the cartridge) 407 following attachment of the second memory unit 470, and FIG. 19B is a side view of the developing cartridge 407, on which the first end member 601 has been omitted from FIG. 19A.

First, a contact board 471 of the second memory unit 470 is inserted into the guide portion 601*j* (see FIG. 19A) provided on the attachment portion 601*i* of the first end member 601. The inserted contact board 471 is then adhered to the first end member 601 using an adhesive or the like so that the contact board 471 is fixed to the developing unit 404. As a result, electrodes 471*a*1, 471*a*2 of the second memory unit 470 are fixed to the first end member 601 via the attachment portion 601*i*.

Next, an attachment surface of an attachment base 474 of the second memory unit 470, which is the surface on the opposite side to the surface that contacts a memory board 472, is fixed to a side face 404*m* of the developing unit 404 using an adhesive or the like (see FIG. 19B). As a result, a memory chip (the second storage element) 472*a*3 of the second memory unit 470 is attached to the developing frame 618 of the developing unit 404. According to this embodiment, the first memory unit 460 that is attached before implementing the method for remanufacturing the developing cartridge 407 is replaced with the second memory unit 470, which has a different shape and so on to the first memory unit 460, and therefore similar effects to the first embodiment can be obtained. In this embodiment, the memory chip 472*a*3 is attached to the developing frame 618 so as to be positioned on the inside of the first end member 601 in the direction of the rotary axis J of the developing frame 618. In other words, the memory chip 472*a*3 is attached to the developing frame 618 so as to be positioned between the first end member 601 and the developing frame 618 in the direction of the rotary axis J of the developing frame 618.

A conductive cable 473 is fixed by soldering or the like to a connection portion 473*a* on the contact board 471 and to a connection portion 473*b* on the memory board 472. As a result, the electrodes 471*a*1, 471*a*2 and the memory chip 472*a*3 are electrically connected. Further, the conductive cable 473 is flexible. Therefore, when the developing unit 404 and the first end member 601 move relative to each other, the conductive cable 473 can deform while maintaining the electrical connections of the connection portions 473*a*, 473*b*. In other words, the conductive cable 473 deforms while maintaining the electrical connections between the electrodes 471*a*1, 471*a*2 and the memory chip 472*a*3 in response to movement of the developing unit 404 relative to the first end member 601.

In the above description, the side face 404*m* of the developing unit 404 serves as the attachment position in which the attachment base 474 is attached to the developing unit 404. As noted in the first embodiment (see FIGS. 13A to 13C), however, a degree of freedom exists in the attachment position of the attachment base 474, and the attachment position is not limited to the position of this embodiment.

As described above, the developing frame 618 rotates about the rotary axis J relative to the first end member 601. At this time, the slack portion of the conductive cable 473 deforms in accordance with the movement of the developing frame 618. Here, a hook-shaped conductive cable holding portion 474*b* is provided on the attachment base 474 (FIG. 19B). The conductive cable 473 is wound at least once around the conductive cable holding portion 474*b*. Thus, when the developing frame 618 moves relative to the first end member 601, a load is unlikely to act directly on the connection portions 473*a*, 473*b* between the memory board 472 and the conductive cable 473. As a result, an effect of preventing disconnection of the electrical connections of the connection portions 473*a*, 473*b* when the developing frame 618 moves relative to the first end member 601 repeatedly, for example, can be expected.

According to this embodiment, as described above, the attachment portion for attaching the first memory unit, which includes electrodes and a storage element, is provided on the end member of the developing unit of the developing cartridge. Thus, when the first memory unit is replaced with the second memory unit described above, even if it is impossible to attach the storage element of the second memory unit to the attachment portion, the storage element of the second memory unit can be attached to the developing unit.

In other words, in the developing cartridge (the second cartridge, the cartridge) having the second memory unit described above, the second electrodes of the second memory unit are disposed on the end member. Further, the second storage element of the second memory unit is disposed on the developing frame.

Note that in this embodiment, the first end member and the developing unit are separated before replacing the first memory unit with the second memory unit. However, the first end member and the developing unit do not have to be separated before replacing the first memory unit with the second memory unit. Further, the conductive cable of the second memory unit may be connected to the second electrodes and the second storage element after attachment of the second electrodes and attachment of the second storage element are complete. At this time, the conductive cable of the second memory unit may be attached once rejoining of the first end member and the developing unit is complete. In other words, the process cartridge remanufacturing method may be said to further include a connection process (a conductive cable attachment process) for electrically connecting the second electrodes and the second storage element using the conductive cable.

According to the present invention, it is possible to provide a remanufacturing method with which a first memory unit attached to a process cartridge prior to remanufacturing can be replaced with a second memory unit having a different shape to the first memory unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2018-160404, filed on Aug. 29, 2018, and Japanese Patent Application No. 2019-035574, filed on Feb. 28, 2019 which are hereby incorporated by reference herein in their entirety.

What is claimed is:

1. A cartridge remanufacturing method for remanufacturing a cartridge from a source cartridge, wherein the source cartridge is capable of being attached to and detached from an image forming apparatus having a main body electrode and the cartridge is capable of being attached to and detached from the image forming apparatus, and wherein the source cartridge includes a first unit and a second unit, the first unit including a first memory unit having a first electrode that is capable of being electrically connected to the main body electrode and a first storage element electrically connected to the first electrode, and the second unit being joined to the first unit so as to be capable of moving relative to the first unit, the cartridge remanufacturing method comprising:

a step of removing the first memory unit from the first unit; and a memory attachment step of attaching a second memory unit, the memory attachment step including a step of attaching a second electrode to the first unit and a step of attaching a second storage element to the second unit, wherein the second electrode and the second storage element are connected by a connecting member so that when the second unit moves relative to the first unit, electrical connection between the second electrode and the second storage element is maintained, and the second electrode is disposed so as to be electrically connectable to the main body electrode.

2. The cartridge remanufacturing method according to claim 1, wherein the first unit includes a drum frame, a drum that has a photosensitive layer and is supported rotatably by the drum frame, and the first memory unit, and wherein the second unit includes a developing frame, and a developer carrier member supported rotatably by the developing frame and configured to supply developer to the drum.

3. The cartridge remanufacturing method according to claim 2, wherein the first unit includes an attachment portion to which the first memory unit is attached, the attachment portion being formed on the drum frame, and wherein the second electrode is fixed to the drum frame via the attachment portion.

4. The cartridge remanufacturing method according to claim 3, wherein the second unit is capable of rotating relative to the first unit about a rotary axis, and the second storage element is attached to the second unit so as to be positioned on the inside of the attachment portion in a direction of the rotary axis.

5. The cartridge remanufacturing method according to claim 1, wherein the second unit includes a developing frame and a developer carrier member supported rotatably by the developing frame and configured to supply developer to a drum having a photosensitive layer, wherein the first unit includes an end member attached to one end portion of the developing frame in a rotary axis direction of the developer carrier member, wherein the developing frame is capable of rotating relative to the end member about a rotary axis, wherein the second electrode is attached to the end member, and wherein the second storage element is attached to the developing frame.

6. The cartridge remanufacturing method according to claim 5, wherein the end member includes an attachment portion to which the first memory unit is attached, and wherein the second electrode is fixed to the end member via the attachment portion.

7. The cartridge remanufacturing method according to claim 6, wherein the second storage element is attached to the developing frame so as to be positioned on the inside of the attachment portion in a direction of the rotary axis.

8. The cartridge remanufacturing method according to claim 1, wherein the connecting member is flexible, and wherein the connecting member is capable of deforming in response to movement of the second unit relative to the first unit while maintaining the electrical connection between the second electrode and the second storage element.

9. The cartridge remanufacturing method according to claim 8, wherein the second memory unit further includes a holding portion around which the connecting member can be wound, and wherein the cartridge remanufacturing method further comprises a step of winding the connecting member around the holding portion.

10. The cartridge remanufacturing method according to claim 1, further comprising connection step of electrically connecting the second storage element to the second electrode using the connecting member.

11. A cartridge remanufacturing method for remanufacturing a cartridge from a source cartridge, wherein the source cartridge is capable of being attached to and detached from an image forming apparatus having a main body electrode and the cartridge is capable of being attached to and detached from the image forming apparatus, and wherein the source cartridge includes a first unit and a second unit, the second unit including a first memory unit having a first electrode that is capable of being electrically connected to the main body electrode and a first storage element electrically connected to the first electrode, and the second unit being joined to the first unit so as to be capable of moving relative to the first unit, the cartridge remanufacturing method comprising:

a step of removing the first memory unit from the second unit; and a memory attachment step of attaching a second memory unit, the memory attachment step including a step of attaching a second electrode to the second unit and a step of attaching a second storage element to the first unit, wherein the second electrode and the second storage element are connected by a connecting member so that when the second unit moves relative to the first unit, electrical connection between the second electrode and the second storage element is maintained, and wherein the second electrode is disposed so as to be electrically connectable to the main body electrode.

12. The cartridge remanufacturing method according to claim 11, wherein the first unit includes a drum frame and a drum that has a photosensitive layer and is supported rotatably by the drum frame, and wherein the second unit includes a developing frame, a developer carrier member supported rotatably by the developing frame and configured to supply developer to the drum, and the first memory unit.

13. The cartridge remanufacturing method according to claim 12, wherein the second unit includes an attachment portion to which the first memory unit is attached, the attachment portion being formed on the developing frame, and wherein the second electrode is fixed to the developing frame via the attachment portion.

14. The cartridge remanufacturing method according to claim 12, wherein the second unit is capable of rotating relative to the first unit about a rotary axis.

15. The cartridge remanufacturing method according to claim 11, wherein the connecting member is flexible, and wherein the connecting member is capable of deforming in response to movement of the second unit relative to the first unit while maintaining the electrical connection between the second electrode and the second storage element.

16. The cartridge remanufacturing method according to claim 15, wherein the second memory unit further includes a holding portion around which the connecting member can be wound, and wherein the cartridge remanufacturing method further comprises a step of winding the connecting member around the holding portion.

17. The cartridge remanufacturing method according to claim 11, further comprising a connection step of electrically connecting the second storage element to the second electrode using the connecting member.

18. A cartridge that is capable of being attached to and detached from an image forming apparatus having a main body electrode, the cartridge comprising:

a photosensitive member unit including a drum frame and a drum that has a photosensitive layer and is supported rotatably by the drum frame;

a developing unit including a developing frame and a developer carrier member supported rotatably by the developing frame and configured to supply developer to the drum, the developing unit being joined to the photosensitive member unit so as to be capable of moving relative to the photosensitive member unit; and a memory unit including an electrode that is capable of being electrically connected to the main body electrode, a storage element, and a connecting member for electrically connecting the electrode to the storage element, wherein the electrode is disposed on one of the photosensitive member unit and the developing unit, and the storage element is disposed on the other of the photosensitive member unit and the developing unit, and wherein the developing unit is configured to be capable of moving relative to the photosensitive member unit in a state where electrical connection between the electrode and the storage element is maintained by the connecting member.

19. The cartridge according to claim 18, wherein the photosensitive member unit includes an attachment portion to which the electrode is attached, the attachment portion being formed on the drum frame, wherein the developing unit is capable of rotating relative to the photosensitive member unit about a rotary axis, and wherein the storage element is attached so as to be positioned on the inside of the attachment portion in a direction of the rotary axis.

20. The cartridge according to claim 18, wherein the connecting member is flexible, and wherein the connecting member deforms in response to movement of the developing unit relative to the photosensitive member unit while maintaining the electrical connection between the electrode and the storage element.

21. The cartridge according to claim 20, wherein the memory unit further includes a holding portion around which the connecting member can be wound.

22. A cartridge that is capable of being attached to and detached from an image forming apparatus having a main body electrode, the cartridge comprising:

a frame;

a developer carrier member supported rotatably by the frame;

an end member attached to one end portion of the frame in a rotary axis direction of the developer carrier member; and a memory unit including an electrode that is capable of being electrically connected to the main body electrode, a storage element, and a connecting member for electrically connecting the electrode to the storage element, wherein the electrode is disposed on the end member and the storage element is disposed on the frame, and wherein the frame is capable of rotating relative to the end member about a rotary axis in a state where electrical connection between the electrode and the storage element is maintained by the connecting member.

23. The cartridge according to claim 22, wherein the end member includes an attachment portion to which the electrode is attached, and wherein the storage element is attached so as to be positioned on the inside of the attachment portion in a direction of the rotary axis.

24. The cartridge according to claim 22, wherein the connecting member is flexible, and wherein the connecting member deforms in response to movement of the frame relative to the end member while maintaining the electrical connection between the electrode and the storage element.

25. The cartridge according to claim 24, wherein the end member further includes a holding portion around which the connecting member can be wound.

* * * * *